US008033453B2

(12) United States Patent
Scanlon

(10) Patent No.: US 8,033,453 B2
(45) Date of Patent: Oct. 11, 2011

(54) ATMEMO

(75) Inventor: Michael Scanlon, Edinburgh (GB)

(73) Assignee: Diebold Self-Service Systems, division of Diebold Incorporated, North Canton, OH (US)

( * ) Notice: Subject to any disclaimer, the term of this patent is extended or adjusted under 35 U.S.C. 154(b) by 708 days.

(21) Appl. No.: 11/480,602

(22) Filed: Jul. 3, 2006

(65) Prior Publication Data

US 2006/0249568 A1 Nov. 9, 2006

Related U.S. Application Data

(63) Continuation-in-part of application No. 11/090,676, filed on Mar. 25, 2005, now Pat. No. 7,419,091.

(60) Provisional application No. 60/697,656, filed on Jul. 7, 2005, provisional application No. 60/557,819, filed on Mar. 30, 2004.

(51) Int. Cl.
*G07F 19/00* (2006.01)

(52) U.S. Cl. ..... 235/379; 235/375

(58) Field of Classification Search ..... 235/375, 235/379

See application file for complete search history.

(56) References Cited

U.S. PATENT DOCUMENTS

| | | | | |
|---|---|---|---|---|
| 5,732,398 | A * | 3/1998 | Tagawa | 705/5 |
| 5,918,216 | A * | 6/1999 | Miksovsky et al. | 705/35 |
| 5,920,848 | A * | 7/1999 | Schutzer et al. | 705/42 |
| 6,304,860 | B1 * | 10/2001 | Martin et al. | 705/43 |
| 6,567,113 | B2 * | 5/2003 | Louis | 347/222 |
| 7,328,839 | B2 * | 2/2008 | Keohane et al. | 235/379 |
| 2002/0116331 | A1 * | 8/2002 | Cataline et al. | 705/39 |
| 2003/0085271 | A1 * | 5/2003 | Laskowski | 235/379 |

* cited by examiner

*Primary Examiner* — Daniel Hess
*Assistant Examiner* — Michael Andler
(74) *Attorney, Agent, or Firm* — Ralph E. Jocke; Daniel D. Wasil; Walker & Jocke

(57) ABSTRACT

An ATMemo arrangement is disclosed. The arrangement allows an ATM to present a person's own reminder memo to that person. A personal memo is authored by an ATMemo customer with a personal computer and then the memo is stored at a remote data store. The data store is accessible by an ATM network. The stored memo is associated with the customer and a display period. Any ATM in the network is operative to display the memo to the customer. Display of a stored memo at an ATM is based on valid customer identification, the memo's display period, and the current date. The ATM accesses and displays the memo if both the ATM customer ID matches the memo author ID and the current date is within the time period for displaying the memo. The ATM can also print the memo on a transaction receipt.

20 Claims, 14 Drawing Sheets

ATMEMO

CROSS REFERENCE TO RELATED APPLICATIONS

This application claims benefit under 35 U.S.C. §119 (e) of U.S. Provisional Application No. 60/697,656 filed Jul. 7, 2005, and claims benefit pursuant to 35 U.S.C. §120 of U.S. application Ser. No. 11/090,676 filed Mar. 25, 2005, which claims benefit under 35 U.S.C. §119 (e) of U.S. Provisional Application No. 60/557,819 filed Mar. 30, 2004, and the disclosures of each are incorporated herein by reference.

TECHNICAL FIELD

This invention relates to cash dispensing automated banking machines. Specifically, this invention relates to automated banking machines which provide information regarding an amount of disposable cash associated with a banking account of a customer.

BACKGROUND ART

Automated banking machines are well known. A common type of automated banking machine used by customers is an automated teller machine (hereinafter "ATM"). ATMs enable customers to carry out banking transactions such as the dispensing of cash, the transfer of funds between accounts, the payment of bills, and/or account balance inquiries. Automated banking machines may also print or dispense items of value such as coupons, tickets, wagering slips, vouchers, checks, food stamps, money orders, and traveler's checks.

The types of banking transactions a customer can carry out at an ATM are determined, in part, by the capabilities and design of the particular banking machine, the capabilities and design of the host banking system with which the ATM interfaces, and the programming of the institution operating the machine. For purposes of this disclosure, references to an ATM, an automated banking machine, or an automated transaction machine are interchangeable.

One of the most common transactions performed by a customer at an ATM is the withdrawal of cash from a bank account. In such a transaction, a customer interfaces with an ATM by identifying himself, identifying the account from which the money is to be withdrawn, and identifying the desired amount of money to be withdrawn. The ATM interfaces with a host banking system to determine if the customer is authorized to dispense cash from the account and has sufficient funds in the account for the desired withdrawal.

While the withdrawal of cash from a bank account through an ATM may satisfy the customer's short term financial needs, it can also create financial problems. For example, if the bank account is a checking account and if the customer has recently written checks drawn from that account which have not yet been posted (i.e., cleared), or if the customer has authorized certain creditors to automatically withdraw periodic payments from that account, the withdrawal of available funds from an ATM can result in checks and/or automatic payments being refused at some later point in time by the bank due to the account having insufficient funds to cover those withdrawals.

Consequently, there exists a need for a system and method which minimizes the risk of checks and/or automatic payments being refused as a result of a customer withdrawing too much cash from an account associated with the checks and/or automatic payments.

DISCLOSURE OF INVENTION

It is an object of an exemplary form of the present invention to provide an automated banking machine.

It is a further object of an exemplary form of the present invention to provide an automated banking machine at which a customer may dispense cash.

It is a further object of an exemplary form of the present invention to provide an automated banking machine which is operative to enable a customer to dispense cash from an account used to draft checks and/or provide automatic payments.

It is a further object of an exemplary form of the present invention to provide an automated banking machine which is operative to minimize the risk of checks and/or automatic payments associated with an account being refused as a result of a customer withdrawing too much cash from the account using the machine.

Further objects of exemplary forms of the present invention will be made apparent in the following Best Mode for Carrying Out Invention and the appended claims.

The foregoing objects maybe accomplished in an exemplary embodiment by an automated banking machine that includes output devices such as a display screen and receipt printer. The machine may further include input devices such as a touch screen, keyboard, keypad, function keys, and card reader. The automated banking machine may further include transaction function devices such as a cash dispenser mechanism for sheets of currency, a depository mechanism and other transaction function devices which are used by the machine in carrying out banking transactions including transfers of value. In the exemplary embodiment the automated banking machine may include at least one computer. The computer may be in operative connection with the output devices and the input devices, as well as with the cash dispenser mechanism, depository mechanism and other physical transaction function devices in the banking machine. The computer may further be operative to communicate with a host banking system and/or other server located remotely from the machine.

In the exemplary embodiment, the computer of the automated banking machine may include software programs that are executable therein. The software programs of the automated banking machine may be operative to cause the computer to output user interface screens through a display device of the machine. The user interface screens may include customer screens which provide a customer with information for performing customer operations such as banking functions with the machine. The user interface screens may further include service screens which provide an authorized user servicing the machine with information for performing service and maintenance operations with the machine. In addition the machine may further include software programs operative in the computer for controlling and communicating with hardware devices of the machine including the transaction function devices.

In one exemplary embodiment, the automated banking machine is operative to enable a customer to withdraw an amount of cash from an account. The machine may output one or more user interface screens through a display device which prompts the user to indicate an amount of cash to withdraw. The machine may contact a host banking system to authorize the withdrawal. In response to receiving the authorization from the host banking system, the machine may dispense the cash to the user through operation of a cash dispenser of the machine.

In the exemplary embodiment, the machine may be operative to cause information associated with the account to be displayed on one or more user interface screens. The information displayed may include an account balance of currently available funds associated with the account of the customer. As used herein such an account balance is referred to as an available balance for an account. The information displayed may also include a further amount associated with the account which represents the amount of cash the customer can withdraw after taking into consideration the available balance and one or more debit and/or credit transactions which are expected to post to the account at a future time. Such further amounts displayed by the machine may correspond generally to a customer's disposable cash.

Examples of expected debits may include payments from the account for a mortgage, rent, car loan, utility bill, student loan, credit card, or any other debit which can be estimated to post one or more times in the future to the account. Expected credits to the account may include a paycheck or other source of income which is expected to post to the account at generally regular intervals. In an exemplary embodiment, the calculation of the disposable cash amount displayed by the automated banking machine may correspond to the amount of currently available funds associated with the account minus the total amount of debits expected to post to the account prior to the next credit which is expected to post to the account.

In an exemplary embodiment, the automated banking machine may provide the user with the ability to withdraw at least a portion of the disposable cash amount in a manner which minimizes the number of inputs into the machine. For example, the machine may provide a user interface screen which directs the user to press a particular keypad key, function key, touch screen button, or provide some other input, if the user would like to have the machine dispense an amount that is equal to all or a lesser portion of the calculated disposable cash amount. In response to the customer providing the input as prompted by the machine, the machine may be operative to contact a host banking system to authorize the dispense and if authorized cause a cash dispenser in the machine to dispense the amount indicated without requiring further inputs from the customer.

In further exemplary embodiments, the machine may output a user interface screen which includes information representative of one or parameters used to calculate the disposable cash amount. Such parameters may include a listing of future debits and/or credits and the dates such debits and credits are expected to post to the account.

In a further exemplary embodiment, the machine may be operative to provide user interface screens with which a user may input and edit the parameters used to calculate the amount of disposable cash for an account. Also, an exemplary embodiment of a system which includes the described automated banking machine may include a web site which enables a customer to input and edit the parameters used to calculate the disposable cash for an account. Such parameters, whether inputted through an ATM screen, web site, or other system, may be stored in a data store in operative connection with the account of the customer.

BEST MODE FOR CARRYING OUT INVENTION

Figure 1:
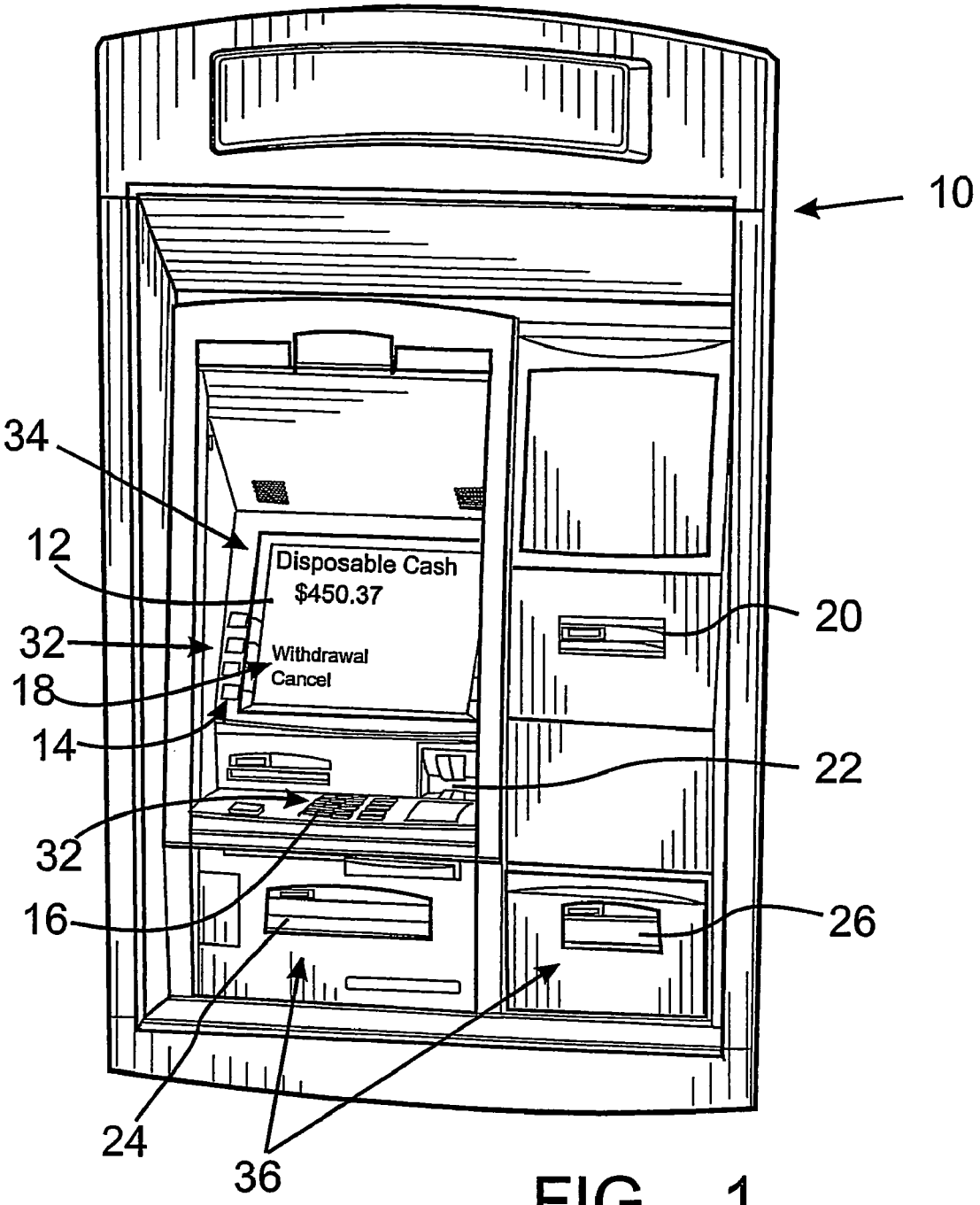
FIG. 1 is a perspective view representative of an exemplary embodiment of an ATM incorporating certain features encompassed by the present invention.

Referring now to the drawings and particularly to FIG. 1, there is shown therein a perspective view of an exemplary automated banking machine 10 such as an ATM. Here the ATM 10 may include at least one output device 34 such as a display device 12. The display device 12 may be operative to provide a customer with a user interface 18 that may include a plurality of screens with menus or other outputs including selectable options for operating the machine. The exemplary embodiment may further include other types of output devices such as a receipt printer 20, speakers, or any other type of device that is capable of outputting visual, audible, or other sensory perceptible information.

The exemplary embodiment of the automated banking machine 10 may include a plurality of input devices 32 such as an encrypting pin pad with keypad 16 and function keys 14 as well as a card reader 22. The exemplary embodiment of the machine 10 may further include or use other types of input devices, such as a touch screen, microphone, or any other device that is operative to provide the machine with inputs representative of user instructions or information. The machine may also include one or more biometric input devices such as a fingerprint scanner, an iris scanner, facial recognition device, hand scanner, or any other biometric reading device which may be used to read a biometric input that can be used to identify a user.

The exemplary embodiment of the automated banking machine 10 may further include a plurality of transaction function devices which may include for example a cash dispenser 24, a depository mechanism 26, cash recycler mechanism, or any other type of device which is operative to perform transaction functions involving transfers of value.

Figure 2:
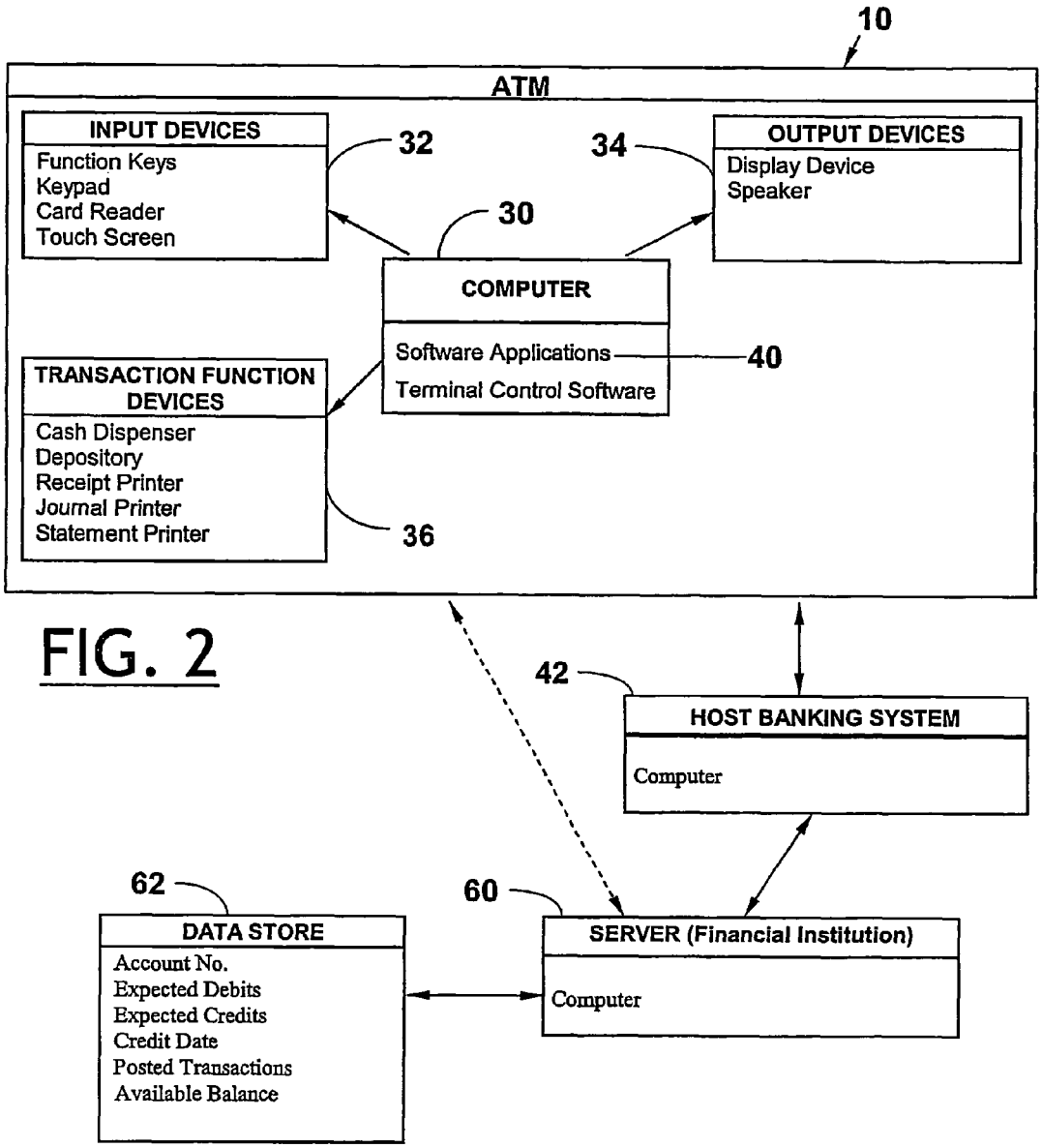
FIG. 2 is a schematic view of the exemplary embodiment of an ATM system encompassed by the present invention.

FIG. 2 shows a schematic view of components which may be included in the automated banking machine 10. The machine 10 may include at least one computer 30. The computer 30 may be in operative connection with the input device (s) 32, the output device(s) 34, and the transaction function device(s) 36. The exemplary embodiment may further include at least one terminal control software component 40 operative in the computer 30. The terminal control software components may be operative to control the operation of the machine by both a customer and an authorized user such as a service technician. For example such terminal control software components may include applications which enable a customer to dispense cash, deposit a check, or perform other transaction functions with the machine. In addition, the terminal control software components may include applications which enable a service technician to perform configuration, maintenance, and diagnostic functions with the machine.

Exemplary embodiments of the automated banking machine 10 are operative to communicate with a transaction processing server which is referred to herein as an ATM host banking system 42. Such an ATM host banking system 42 may correspond to a remote computer which is operative to authorize the automated banking machine 10 to perform transaction functions for users such as withdrawing cash from an account through operation of the cash dispenser 24, depositing checks or other items with the depository mechanism 26, performing a balance inquiry for a financial account and transferring value between accounts.

Terminal control software components 40 may be operative to organize and display with a user interface different transaction functions into a hierarchy using a plurality of menus and submenus. A menu may be visually and/or audibly output to the customer for each of the different ATM states. Each menu may be operative to list those functions which may be performed in any given ATM state. Selecting an option or function visually listed or verbally described in a menu will usually cause the ATM to change to a different state.

Terminal control software may be operative to generate a user interface screen which includes one or more menu options for displaying an account balance corresponding to a selected account associated with the customer. Such an account balance may correspond to the currently available funds associated with the account. In an exemplary embodiment the account balance is determined with the ATM contacting the host banking system which is operative to access an account balance associated with an account of the customer.

In addition to being operative to display an account balance representative of the currently available funds in the account, the ATM may be operative to determine a further amount referred to herein as the disposable cash amount associated with an account. The disposable cash amount may correspond to an estimate for the amount of value that will be left in the account after one or more expected transactions have posted to the account before the next paycheck or other credit is expected to be deposited in the account.

In an exemplary embodiment, an automated banking machine may be operative to enable a customer to provide information representative of a financial account through operation of at least one input device of the ATM and determine through operation of at least one computer of the ATM, a disposable cash amount associated with the account. In addition, the ATM may be operative to display through operation of the at least one computer of the ATM, the disposable cash amount through at least one output device of the ATM. Once the disposable cash amount is displayed, the automated banking machine may be operative to enable a customer to dispense an amount of cash equal to all or a lesser portion of the disposable cash amount without having the customer enter an amount into an input device of the ATM.

In this described exemplary embodiment the ATM may request and receive the disposable cash amount from the host banking system or other remote server. In an alternative exemplary embodiment, rather than requesting and receiving the disposable cash amount from the host banking system or other server, the ATM may be operative to calculate the disposable cash amount directly. In this described exemplary embodiment the automated banking machine may be operative to access the parameters (i.e., information) usable by the machine to calculate the disposable cash amount for the specified account from a host banking system or other server. In exemplary embodiments the automated banking machine may also enable the customer to view and/or edit the parameters used to calculate the disposable cash amount. Edited data parameters may then be transmitted back to the host banking system or other server and stored in association with the account.

In exemplary embodiments an account balance generally represents the currently available funds in an account and is referred to herein as an "Available Balance". An account's disposable cash amount is determined by taking into consideration the account's Available Balance, and parameters associated with expected future transactions and/or transactions that have previously posted to the account. Such parameters may include the dates and amounts of prescribed future debits to that account (hereinafter "expected debits"), if any, and the dates and amounts of prescribed future credits to that account (hereinafter "expected credits"), if any. The term "prescribed" as used herein means that the customer has selected, through either a manual or automatic process, which future debits and/or credits to a specified bank account are to be used in the calculation of the account's disposable cash amount.

Regarding expected credits, any credit to a specified account can be prescribed as such by the customer. For example, expected credits can be any payments that are automatically credited to the specified account on a periodic basis, any payments that are electronically deposited or transferred to the specified account, and/or any payments that are manually deposited by the customer into the specified account (i.e., cash or check deposits). Specific examples of such payments that can be used as expected credits include: wage credits, alimony or child support credits, unemployment benefit credits, tax refund credits, dividend credits, interest credits, and the like. The interest credits may include the interest earned with respect to the specified account or another account which is deposited into the specified account.

Regarding expected debits, any debit to a specified account can be prescribed as such by the customer. For example, expected debits can be any withdrawals that are automatically debited from the specified account on a periodic basis, any withdrawals that are electronically debited or transferred from the specified account, and/or any orders that are manually generated by the customer to be paid from the specified account (i.e., checks). Specific examples of such withdrawals that can be prescribed as expected debits include: spending cash withdrawals, mortgage payments, alimony or child support payments, credit card payments, utility payments, insurance payments, savings or pension plan payments, and the like.

In exemplary embodiments, customers may identify expected debits and credits manually by individually inputting expected debit/credit amounts and associated dates or date ranges into a user interface adapted to receive such information. Such a user interface may be provided by an ATM, a web site that provides access to the account, or any other system that is operative to store expected debit/credit information in a data store in association with an account. For example, in an exemplary embodiment a web server may provide user interface web pages at a web site which enable computers on a global communication network such as the Internet to remotely input expected debit/credit amounts, dates and other associated data from their personal computers. Expected debit/credit data provided though use of the web pages may be received by the web server and stored in a data store in association the account that was accessed through use of the web server.

In further exemplary embodiments the system used to input expected debit/credit amounts may be operative to automate the process by automatically generating expected debit/credits responsive to previously posted transactions to the account. Also in exemplary embodiments, a user interface may present to the customer which lists previously posted transactions, and the customer may select which previously posted transactions correspond to expected debits/credits. The user interface may be responsive to the selected transaction to cause expected debit/credits to be stored in the data store in association with the account. In further exemplary embodiments, an ATM may include an invoice reader which is capable of reading information from a utility bill, credit card bill, or other printed bill or invoice which requires a payment. The invoice reader may be capable of scanning the printed bill and acquire information (i.e., payment amount, due date, biller description) usable by the ATM to cause an expected debit to be generated and stored in association with the specified account. The invoice reader may also be capable of determining from a printed bill whether the payment amount corresponds to a one time payment or periodic payment. Corresponding expected debits generated from the scanned invoice may then be set up as either a one time expected debit for the associated one time payment date, or may be setup as ongoing expected debits which occur periodically (e.g., monthly, quarterly, yearly) and have a known fixed payment amount or a variable payment amount which can be estimated to fall below a specified amount.

As shown in FIG. 2 in the exemplary embodiment, a host banking system 42 and/or other server 60 may be in operative connection with one or more data stores 62 which include stored therein the parameters such as expected debits/credits 64 for an account that are prescribed by the customer. The server 60 associated with the financial institution may also be operative to provide the Available Balance amount for the account and a listing of transactions that have posted to the account. Such an Available Balance amount and a listing of posted transactions for an account may be stored in the one or more data stores 62 in association with the account and the expected debits/credits. However, it is to be understood that the Available Balance and listing of posted transactions for an account may also be acquired by the server 60 from another data store or server that provides information associated with a customer's account.

The expected debits or credits stored in the data store 62 are stored in association with the customer's account. The information stored for each expected debit or credit in the data store 62 may include an amount and a date or date range the expected debit or credit is expected to post to the account. The dates stored in association with the expected debits or credits may correspond to a specific date or date range that occurs only once or may be a date or date range that re-occurs every week, month, or year for example. In addition, the information stored for each expected debit or credit in the data store 62 may also include the name of the payee (or payor) or other identifying description that is associated with the transaction.

In an exemplary embodiment, the server 60 may be operative to calculate the disposable cash amount responsive to the information associated with the account which are stored in the data store 62 or are accessed from other servers. The ATM of the exemplary embodiment may be operative to determine this disposable cash amount by communicating with the host banking server 42 which in turn communicates with the server 60 to request the disposable cash amount. In alternative exemplary embodiments, the ATM may be operative to securely communicate directly with the server 60 through a public or private network to acquire the disposable cash amount from the server 60. In further alternative exemplary embodiments, the ATM may be operative to acquire the parameters usable to calculate the disposable cash amount from the server 60. In further alternative exemplary embodiments, the host banking system may be operative to calculate the disposable cash amount in response to the information accessed from the server 60 for an account specified by the ATM.

As shown in Equation 1, an ATM, host banking system, or other server, may be operative to calculate the disposable cash, by subtracting the total of one or more expected debits (hereinafter referred to as the account's "Total Forthcoming Debits" amount) from the current Available Balance for the account.

$$\text{Disposable Cash} = \text{Available Balance} - \text{Total Forthcoming Debits} \quad [1]$$

The Total Forthcoming Debits may correspond to the total amount that is expected to be debited from the account between the day on which the disposable cash amount is requested (hereinafter referred to as "Current Date") and the day of the next prescribed future credit to that account (hereinafter referred to as next "Credit Date"). In an exemplary embodiment, the next Credit Date may correspond to the date of the next expected credit after the Current Date. Also, in exemplary embodiments, the next Credit Date may correspond to a date selected by the customer. For example, the next Credit Date may correspond to a day of the month after which the customer's one or more paychecks or other sources of income are expected to be posted to the account.

In exemplary embodiments, transactions which were expected to occur on the Current Date or earlier, may not have yet posted to the account when a calculation for disposable cash is made. The Account Balance will be relatively higher than would otherwise be if such transactions posted to the account instantly. As a result, a Disposable Cash amount calculated from this inflated Available Balance may produce an amount that is too high to safely withdraw cash from the account and still leave sufficient funds to cover the Total Forthcoming Debits.

In a further exemplary embodiment, the Disposable Cash amount may further be calculated responsive to expected debits which were expected to post to the account by the Current Date but have not yet posted. Such debits are hereinafter referred to as the "Non-Posted Debits". In an exemplary embodiment, debits posted to an account may be compared to the listing of expected debits stored in association with the account to determine which of the stored expected debits expected to have occurred by the Current Date have not yet posted to the account. In this described exemplary embodiment, the Disposable Cash amount may be further calculated according to Equation 2 by subtracting out the total of Non-Posted Debits.

$$\text{Disposable Cash} = \text{Available Balance} - \text{Total Forthcoming Debits} - \text{Non-Posted Debits} \quad [2]$$

The comparison between posted debits and stored expected debits may be performed by the ATM, host banking system, or other server. All stored expected debits with dates or date ranges that fall within a predetermined period before and including the Current Date may be compared to debits posted to the account on the corresponding dates or within the corresponding date ranges. Such a predetermined period may be on the order of several days or longer for example. Matching stored expected debits with posted debits may be accomplished by comparing the value amounts and descriptive information of the expected debits to the posted transactions for the account. In the exemplary embodiment, date ranges stored for the expected debits may be on the order of several days or longer to increase the accuracy of the comparison.

In addition, a comparison may also be made between expected debits after the Current Date and the posted transactions for an account to determine if one or more of the expected debits may have been posted to the account earlier than expected. In this described exemplary embodiment, such expected debits which have posted early may be omitted from the Total Forthcoming Debits used to calculate the Disposable Cash.

In exemplary embodiments, multiple credits may post to an account throughout a month or other time range. The customer may not intend such credits to be used for disposable cash as soon as they post to the account. Rather a customer may wish to allocate these credits for use with paying future debits that post after the next Credit Date such as a large mortgage or other payment. Unfortunately, such credits that post to the account by the Current Date will likely be reflected in the Available Balance, causing the calculated Disposable Cash amount to be higher than the customer may prefer.

In a further exemplary embodiment the ATM, host banking system, or other server, may be operative to calculate the Disposable Cash according to Equation 3, in which the one or more credits previously posted to the account (hereinafter referred to as "Posted Credits") are subtracted from the Available Balance.

$$\text{Disposable Cash} = \text{Available Balance} - \text{Total Forthcoming Debits} - \text{Non-Posted Debits} - \text{Posted Credits} \quad [3]$$

In this described exemplary embodiment, the Posted Credits may correspond to credits which have posted to the account after the Credit Date which occurred prior to the Current Date. For example, the Credit Date may be specified by the customer as occurring on the 2nd day of each month. If the Current Date corresponds to the 20th day of the month, then the Posted Credits would correspond to those credits which posted to the account between the 2nd day and 20th day of the month. Such Posted Credits which are not intended to be included in the Disposable Cash amount may include a paycheck issued on the 15th of the month for example, which may be needed to cover expected debits after the next Credit Date.

As shown in Equations 1-3, the parameters of Total Forthcoming Debits, Non-Posted Debits, and Posted Credits correspond to absolute (i.e., positive) values or sets of absolute values which are subtracted from the determined Available Balance for the account. In other exemplary embodiments, the equations may be modified to reflect these values being negative and/or positive. Further, in other exemplary embodiments the Total Forthcoming Debits, Non-Posted Debits, and/or Posted Credits may not be calculated individually and then subtracted from the Available Balance. Instead, the individual transactions which comprise these parameters may be subtracted from the Available Balance individually or in other groupings. As used herein subtracting a first number from a second number (e.g., N2–N1) includes adding a negative version of the first number to the second number (e.g., N2+–N1).

In exemplary embodiments, where the ATM is operative to calculate the Disposable Cash amount, the ATM may request and receive from a host banking system or other server, the parameters for performing the Disposable Cash calculation. Such parameters may include the Available Balance and Total Forthcoming Debits, Non-Posted Debits, and Posted Credits for example. However, in alternative exemplary embodiments, the ATM may be operative to request and receive from the host banking system or other server parameters used to calculate the Total Forthcoming Debits, Non-Posted Debits, and Posted Credits. Such parameters may include for example, the expected debits, expected credits, and the Credit Date value, and posted transactions associated with an account. The ATM may calculate the Total Forthcoming Debits, Non-Posted Debits, and Posted Credits from this accessed information.

FIGS. 3-9 are schematic views of one exemplary embodiment of an ATM encompassed by the present invention. Specifically, FIGS. 3-9 show schematic views of an ATM display in a plurality of different states. Such states are examples of one exemplary path a customer may take through the hierarchy of user interface menus for purposes of operating an ATM to determine an account's disposable cash amount and to dispense cash in an amount equal to all or a portion of the determined disposable cash amount.

Figure 3:
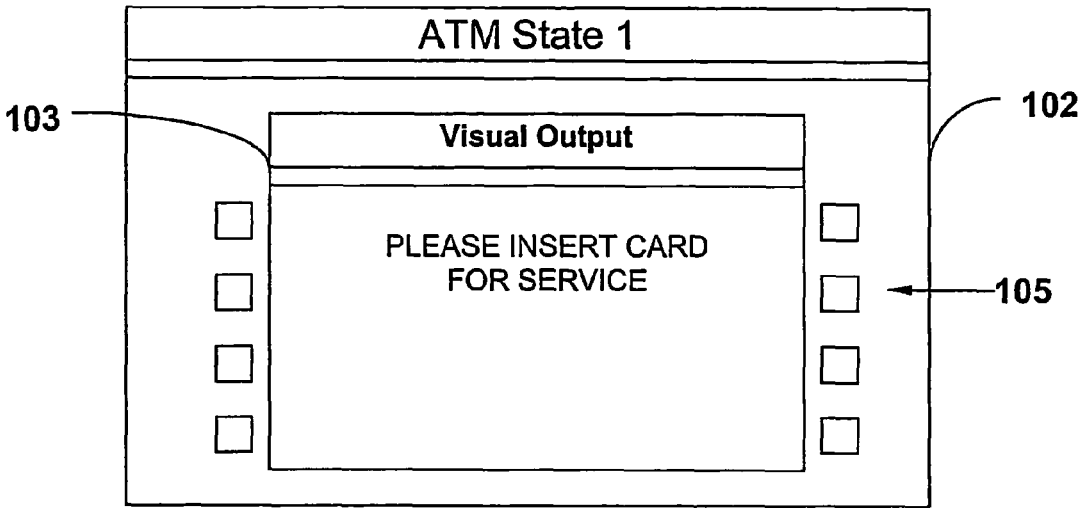
FIGS. 3-9 are schematic views of one exemplary embodiment illustrating a plurality of different ATM states encompassed by the present invention.

FIG. 3 shows an ATM display in a first mode or state 102 which may be active when a customer first approaches the machine. Here the ATM is operative to attract or invite customers to use the services of the ATM. This ATM shows a visible output through display screen 103. The ATM may also have function keys 105 which are positioned on both sides of display screen 103, and at set locations along the display screen's perimeter such that they can correspond with the location of menu options displayed to the customer on the screen. In an alternative exemplary embodiment, display screen 103 may include a touch screen. In such an embodiment, the display screen may include graphical buttons associated with the menu options.

The visible output displayed in FIG. 3 informs the customer that, in order to initiate an operation, the customer must perform an action to identify the customer or an account of the customer. In this described exemplary embodiment, the ATM displays instructions which prompt the customer to insert an ATM card into a card reader of the ATM. Such an ATM card may include an account number associated with the customer. In other exemplary embodiments, the ATM may be operative to wirelessly communicate with a smart card or other portable computing device capable of providing customer and/or account information.

Figure 4:
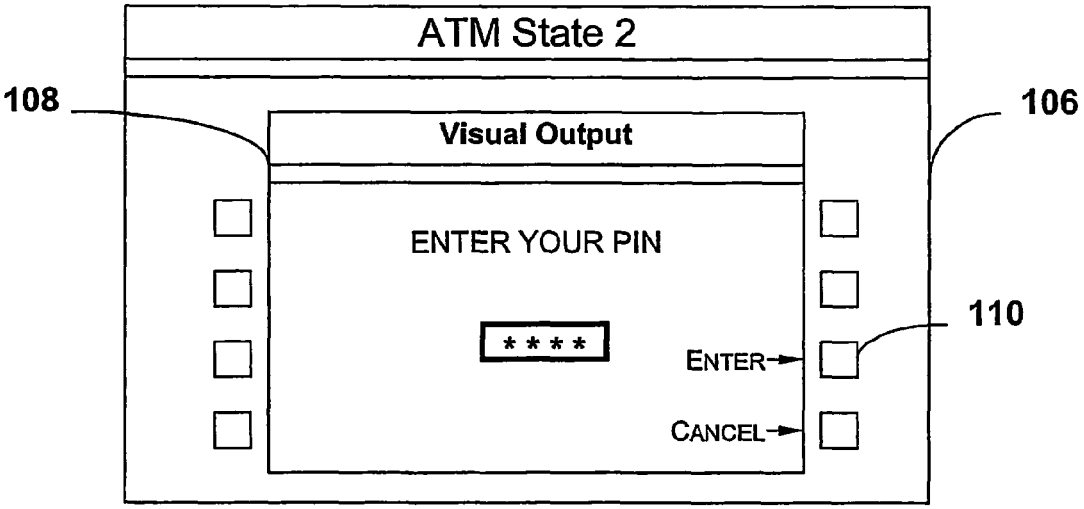

As shown in FIG. 4, once the card reader of the ATM has read account information or other identifying information from the customer's card, the exemplary embodiment of the ATM is operative to change to a second state 106. In this second state, a visible output 108 requests that the customer enter further information used to validate the customer. Such further information may include a password or Personal Identification Number ("PIN") associated with the account information read from the card. In this particular embodiment, as a customer presses each of the numeric keys of the ATM's keypad which correspond to the customer's PIN, the ATM may acknowledge each input by displaying an asterisk (*) symbol. In other exemplary embodiments the ATM may prompt the customer to validate his or her identity through use of a biometric reader of the ATM.

Figure 5:
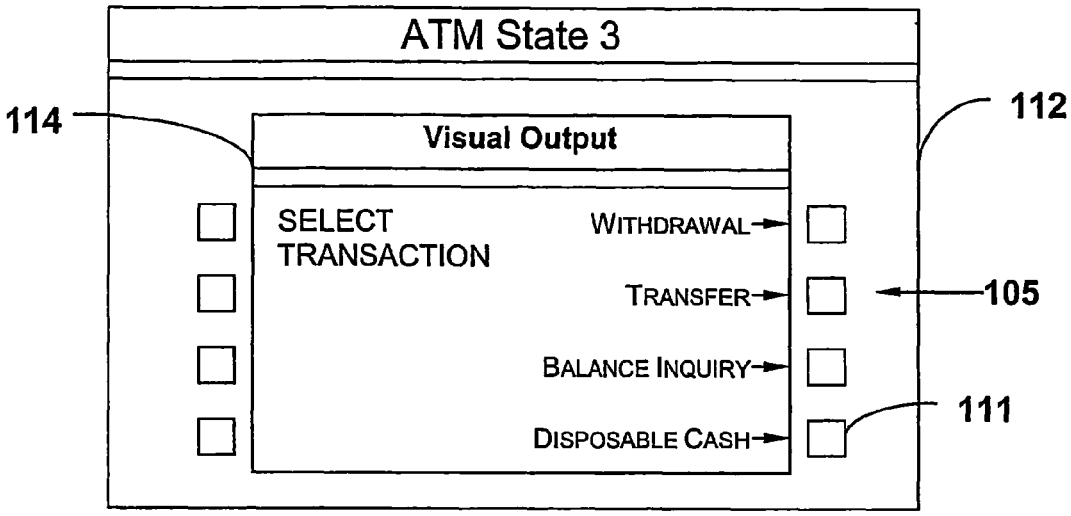

Once the customer inputs the PIN and presses the function key indicated with reference numeral 110, the exemplary ATM changes to a third state 112 illustrated in FIG. 5. As shown in FIG. 5, this third state 112 produces visible output 114 identifying a list of transaction functions from which the customer may choose. Each function corresponds with one of the function keys 105 adjacent the display screen of the ATM.

In this described exemplary embodiment, the visible output 114 includes indicia representing a Disposable Cash transaction adjacent the function key indicated with reference numeral 111. If the customer wishes to choose the Disposable Cash transaction, the function key indicated with reference numeral 111 may be pressed. In response, the ATM changes to a fourth state.

Figure 6:
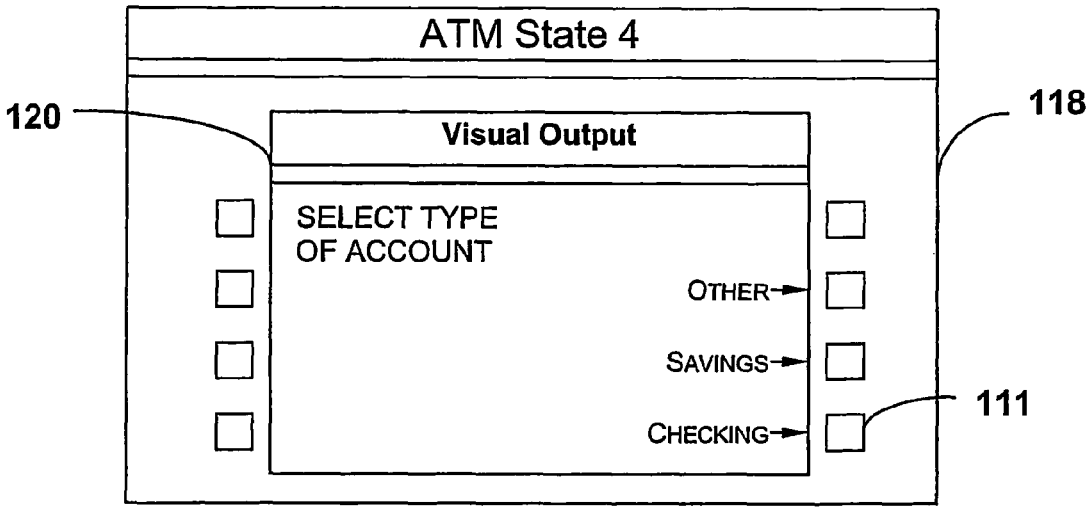

FIG. 6 shows an example of a fourth state 118. In this state, the ATM is operative to accept the selection of the account for which the customer wishes to see the disposable cash amount. Here the ATM produces a visible output 120 which lists a plurality of accounts for which the disposable cash amount can be displayed.

Typically, the disposable cash feature will be used in conjunction with a checking account. In such an exemplary embodiment, the customer would press the function key indicated with reference numeral 111. When the customer presses the function key indicated with reference numeral 111, this exemplary embodiment of the ATM changes to a fifth state.

Figure 7:
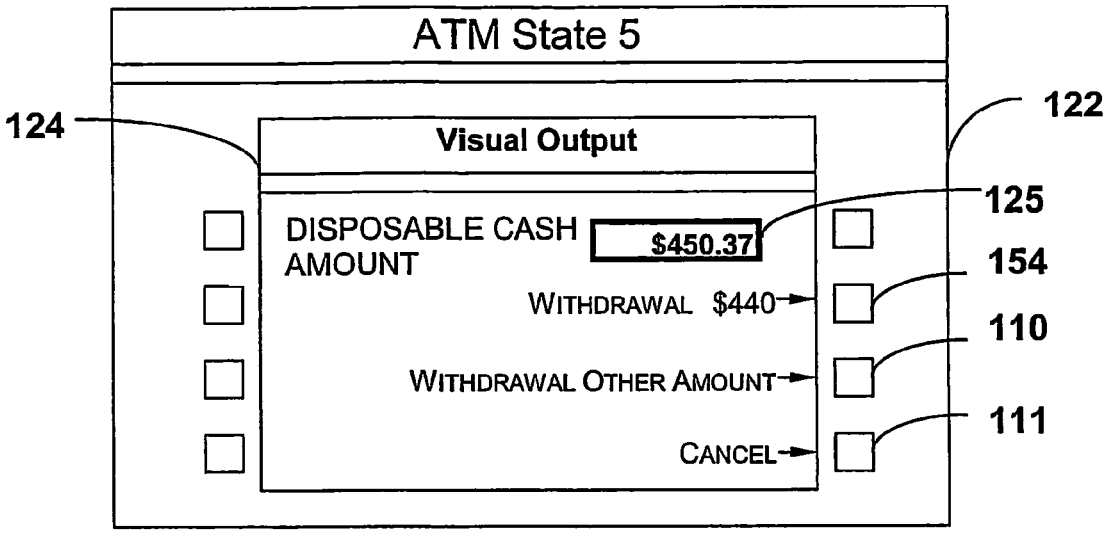

FIG. 7 shows an example of fifth state 122. In this state, a visual output 124 shows the disposable cash amount 125 for the selected account. The visual output 124 may also inquire whether the customer wishes to withdraw the disposable cash from the account. However, because many ATMs limit the amount of cash that can be withdrawn at one time and typically require a withdrawal of cash to be a multiple 5, 10, 20 or other amount of currency, the ATM may also be operative to calculate and display the portion of the disposable cash that the ATM is capable of dispensing at one time. If the customer wants this portion of the disposable cash to be dispensed, the function key 154 associated with this indicated amount may be pressed. On the other hand, if the customer wishes to withdraw a different amount, the function key indicated with reference numeral 110 may be pressed, and the ATM may prompt the user to enter a different amount.

Figure 8:
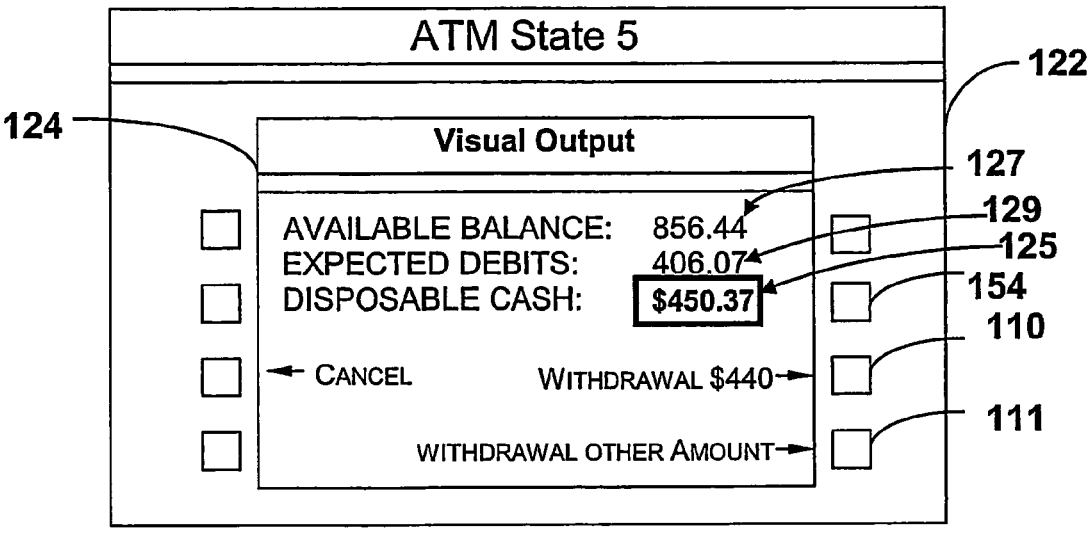

FIG. 8 shows an alternative exemplary embodiment of the visual output 124 for the described fifth state. Here the visual output may show the parameters used to calculate the disposable cash amount. Such parameters may include the Available Balance 127 associated with the selected account. Such parameters may also include the total of expected debits 129 associated with the account.

The expected debit total displayed may correspond to the Total Forthcoming Debits previous described or the sum of the Total Forthcoming Debits and Non-Posted Debits previously described. In further exemplary embodiments, the ATM may display each of the individual expected debits and any other information that is used to calculate the disposable cash amount.

In the exemplary embodiment, the customer may press the function key indicated with reference numeral 110 to have the ATM dispense cash in an amount equal to the portion of the disposable cash indicated. In response to the input, the computer of the ATM may be operative to communicate with a host banking system to authorize the withdrawal of cash from the account in an amount equal to the indicated portion of the disposable cash amount. In response to receiving a message from the host banking system authorizing the withdrawal, the computer of the ATM may be operative to cause the cash dispenser of the ATM to operate to dispense an amount of cash corresponding to the portion of the disposable cash indicated.

Figure 9:
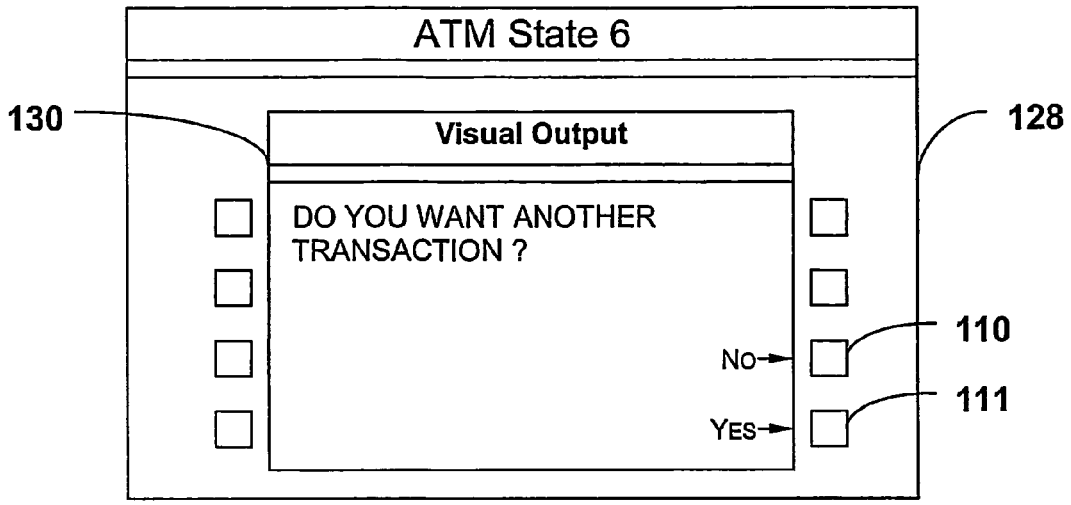

In an exemplary embodiment after the cash is dispensed, the ATM may change to a sixth state. FIG. 9 shows an example of sixth state 128. In this state, a visual output 130 inquires whether the customer wishes to select another transaction. If the customer wishes to proceed with another transaction, the function key indicated with reference numeral 111 may be pressed. On the other hand, if the customer does not wish to proceed with another transaction, the function key indicated with reference numeral 110 may be pressed. If the function key indicated with reference numeral 111 is pressed, the exemplary embodiment of the ATM may return to a previous state such as the described third state 112 shown in FIG. 5 for selecting another transaction. On the other hand, if the function key indicated with reference numeral 110 is pressed, the exemplary embodiment of the ATM may conclude the transaction and return to a previous state such as the described first state 102 shown in FIG. 3 which requests a new customer to swipe or insert their card for service.

In the example shown in FIGS. 7 and 8, the account's Disposable Cash amount is a positive value. However, it is within the scope of this invention that the Disposable Cash amount may be a negative value. This may occur when the dollar amount of the Expected Debits is greater than the account's Available Balance. The display of a negative disposable cash amount informs the customer that, based on the prescribed information, if funds are not transferred into the account at least equal to the negative value, there is a high probability that some of the expected debits will be refused by the bank due to insufficient funds. In such a situation, it is within the scope of further exemplary embodiments for the ATM to be operative to inquire whether the customer wishes to transfer funds into the account. If the customer selects to do so, the ATM may be operative to change to a state which inquires: from which account should the funds be transferred, and the amount of the transfer.

FIGS. 10-14 are schematic views of an alternative exemplary embodiment of an ATM. Specifically, FIGS. 10-14 show schematic views of another exemplary path a customer may take through the hierarchy of user interface menus or screens for purposes of having an ATM determine an account's Disposable Cash amount.

In this described exemplary embodiment, the ATM may proceed through the first and second states as shown in FIGS. 3 and 4. However, in the exemplary ATM illustrated in FIGS. 10-14, once the customer inputs the PIN (see FIG. 4), the ATM is operative to change to an alternative third state 150 illustrated in FIG. 10.

Figure 10:
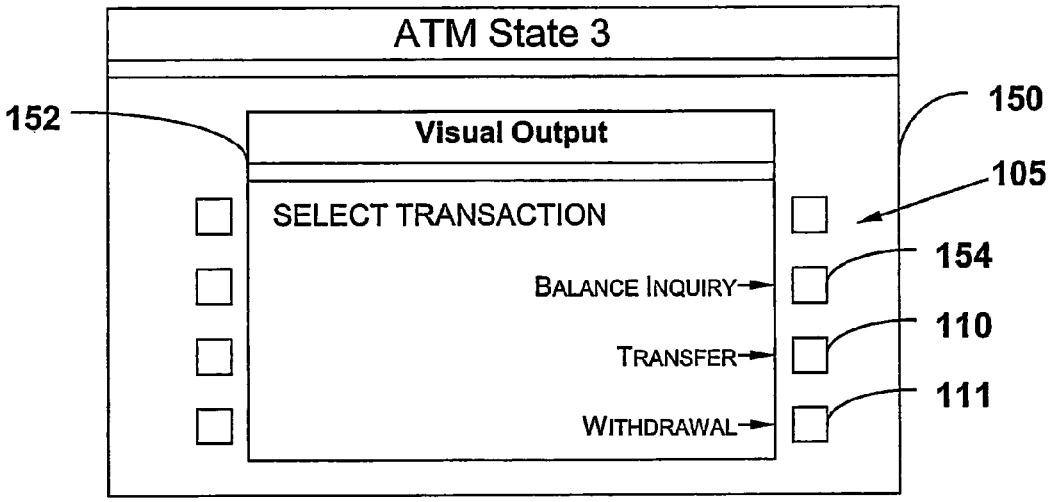
FIGS. 10-20 are schematic views of another exemplary embodiment illustrating a plurality of different ATM states encompassed by the present invention.

As shown in FIG. 10, when in this third state, a visible output 152 identifies a list of transaction functions from which the customer can choose, and visually points to the function keys 105 that are operative to select each transaction function. However, unlike the embodiment illustrated in FIG. 5, in this exemplary embodiment, indicia representative of a Disposable Cash transaction may not be displayed. Rather, the determination of the disposable cash amount may be associated with another type of transaction such as a withdrawal and/or balance inquiry transaction. As a result, the disposable cash amount may be shown in the particular ATM states that are associated with these transactions.

Figure 11:
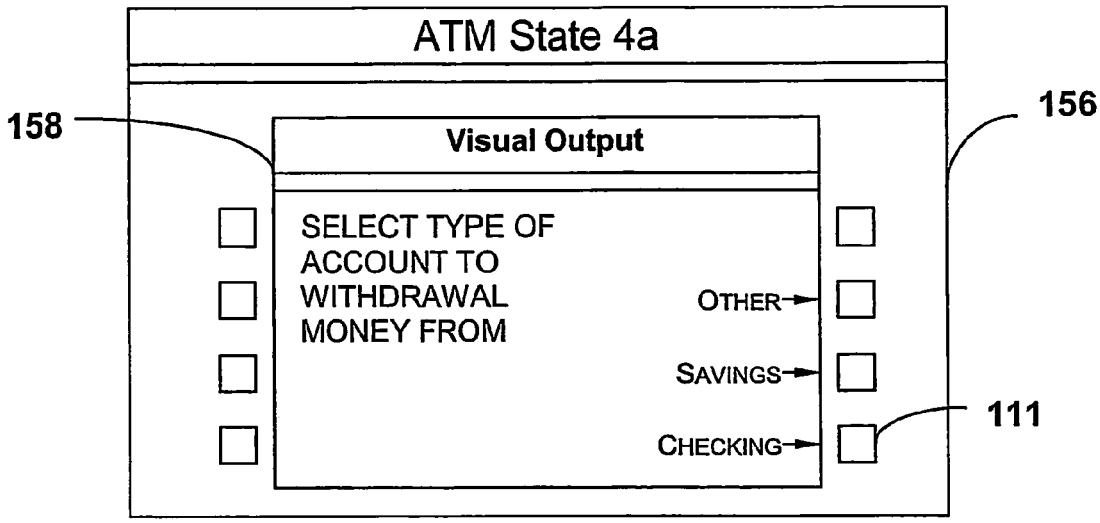
Figure 12:
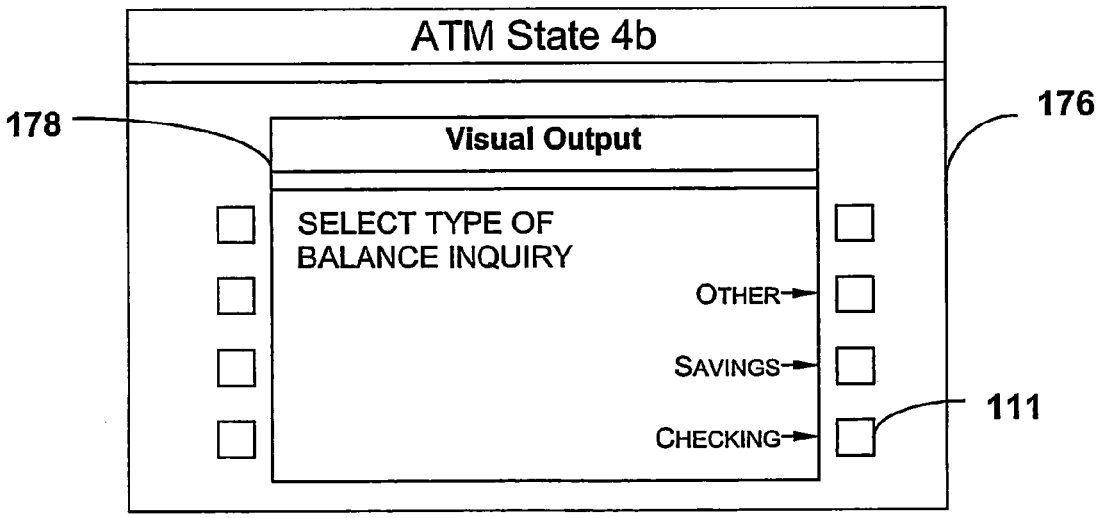
Figure 13:
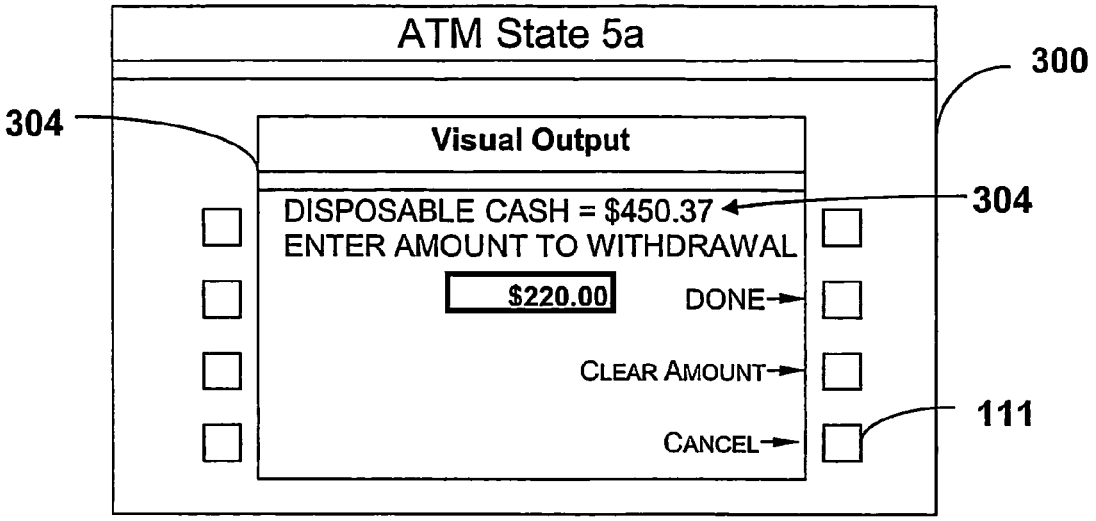

For example as illustrated in FIG. 10, if the customer wishes to use the ATM to withdraw funds from a bank account, the customer may press the function key indicated with reference numeral 111. In response the ATM changes to a fourth state 156 (FIG. 11). If the customer wishes to check on the balance of a particular account, the customer may press the function key indicated with reference numeral 154. In response the ATM may change to an alternative fourth state 176 (FIG. 12). These fourth states 156, 176 are illustrated in FIGS. 11 and 12, and include visual outputs 158, 178 which request the customer to indicate which account to use for the respective transactions of a withdrawal or balance inquiry.

Once an account is selected in either of the described fourth states 156, 176, the ATM may proceed to a fifth state which is specific to the type of transaction requested. For example, for a withdrawal transaction the ATM may change to a fifth state 300 shown in FIG. 13. Here the ATM may prompt the customer to enter a specific amount to withdraw. However, to aid the customer in determining how much to withdraw, the visual output 302 may include the Disposable Cash amount 304. In an alternative exemplary embodiment, the visual output 302 may not immediately display the Disposable Cash amount, but may indicate which function key to press to view the Disposable Cash amount.

Figure 14:
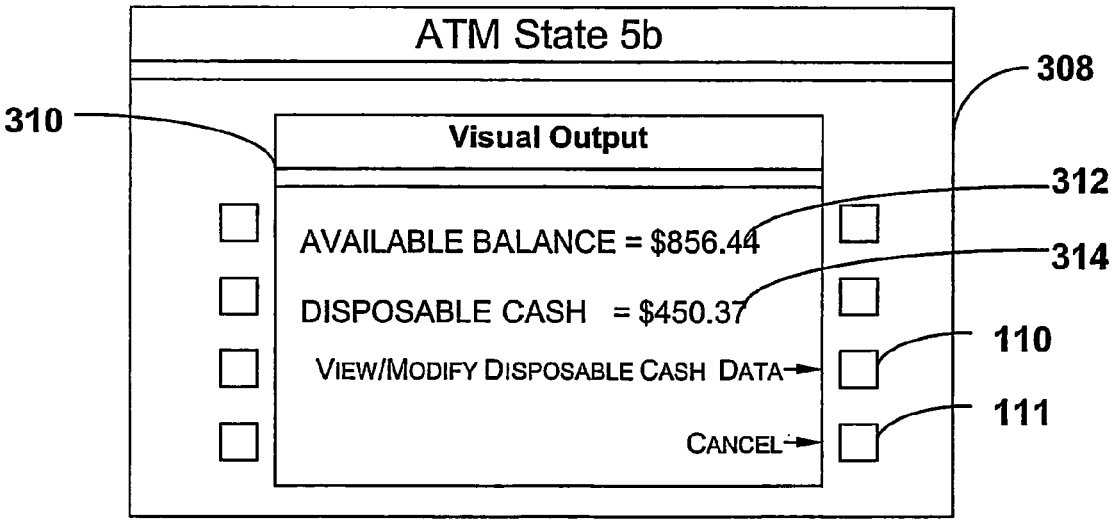

Referring back to FIGS. 10 and 12 if the user selects to view a Balance Inquiry (FIG. 10) and selects the account (FIG. 12), the ATM may change to a fifth state 308 shown in FIG. 14. Here the ATM may provide a visual output 310 which displays the Available Balance 312 and the Disposable Cash amount 314 for the account. As discussed previously, exemplary embodiments of the ATM may be operative to display the parameters used to calculate the Disposable Cash amount as well. For example, in the exemplary embodiment of the fifth state 308 shown in FIG. 14, the visible output 310 may indicate that the function key indicated with reference numeral 110 may be pressed to view and/or modify the parameters used to calculate the Disposable Cash amount. In response to this key being pressed, the ATM may change to a sixth state 206 illustrated in FIG. 15.

Figure 15:
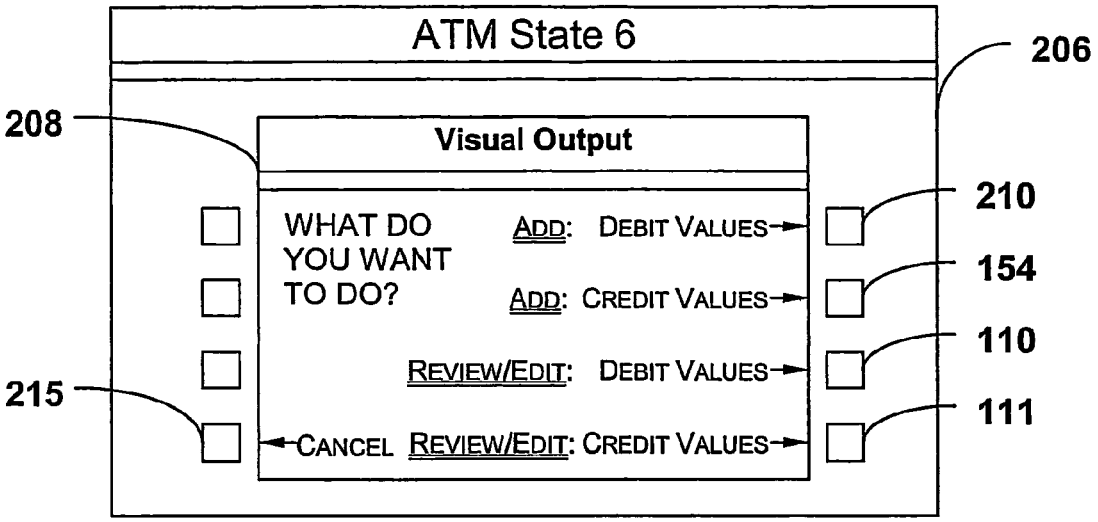

As shown in FIG. 15, when in this described sixth state 206, a visual output 208 indicates which function keys to press to add, view and edit expected debits and credits used to calculate the Disposable Cash amount. In this example, if the customer wishes to add a new expected debit or expected credit value, then the function keys indicated with reference numerals 210 or 154 respectively, may be pressed. Similarly, if the customer wishes to review/edit the date and amount of a prescribed expected debit or a prescribed expected credit, then the function keys indicated with reference numerals 110 or 111 respectively, may be pressed. Finally, if the customer no longer wishes to review or modify the parameters used in the disposable cash calculation, the function key indicated with reference numeral 215 may be pressed. If this function key is pressed, the ATM may change back to a previous state such as the described third state 150 shown in FIG. 10.

Figure 16:
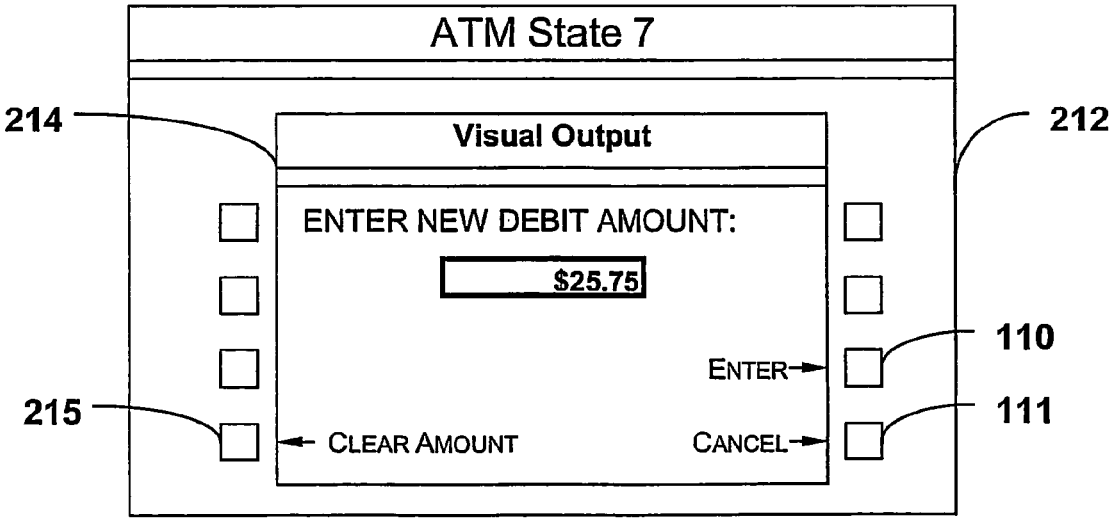
Figure 17:
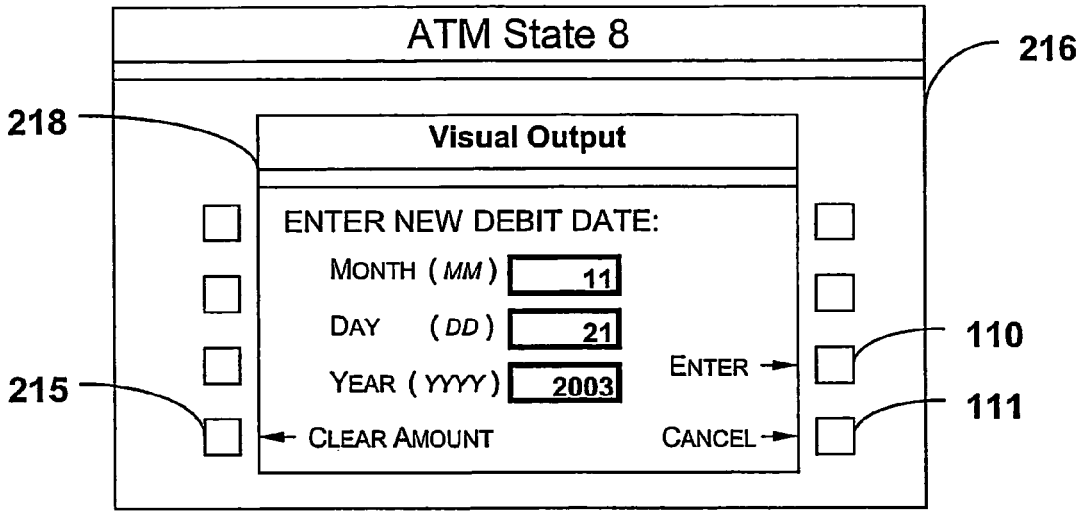
Figure 18:
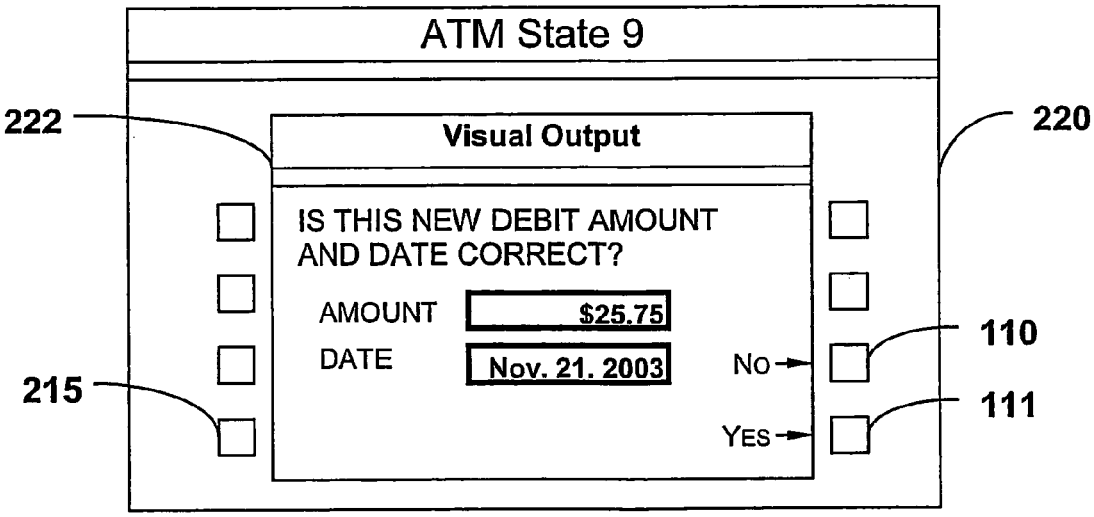

FIGS. 16-18 show examples of states and associated visual outputs that the ATM may present to a customer to add an expected debit value. In this described exemplary embodiment, when a customer wishes to add a new expected debit, the function key indicated with reference number 210 in the sixth state shown in FIG. 15 may be pressed. In response, the ATM may change to seventh state 212 illustrated in FIG. 16.

As shown in FIG. 16, when in state 212, a visual output 214 prompts the customer to enter the amount of the expected debit to be added. In this specific example, the amount to be added is "$25.75". This amount can be added by using the key pad associated with the ATM.

If the customer no longer wishes to add a new expected debit, the function key indicated by reference number 111 may be pressed. Upon doing so, the ATM changes back to the sixth state shown in FIG. 15. However, if the customer does wish to add a new expected debit, but the amount entered with the ATM's keypad was incorrect, the function key indicated with reference number 215 may be pressed. Upon doing so, the ATM clears the amount; thus, enabling the customer to enter the correct amount.

If the correct amount has been entered and the customer still wishes to proceed with adding this amount, the function key indicated with reference numeral 110 would be pressed. Upon doing so, the ATM would be operative to change to eighth state 216 illustrated in FIG. 17.

As shown in FIG. 17, when in state 216, a visual output 218 prompts the customer to enter the date the newly entered expected debit is expected to post to the selected account. In this specific example, the date is "Nov. 21, 2003". This date is added by using the key pad associated with the ATM. In alternative exemplary embodiments, the visual output 218 may prompt the user to enter a range of dates in which the debit may be expected to post to the account. In further exemplary embodiments, the customer may be enabled to leave the month and year fields blank or with zero values, to indicate that the debit is expected to post to the account each month on the specified day or range of days.

If the customer no longer wishes to add a new expected debit, the function key indicated with reference numeral 111 may be pressed. Upon doing so, the ATM may return to the sixth state shown in FIG. 15. However, if the customer does wish to add the new expected debit, but the date entered is incorrect, the function key indicated with reference numeral 215 may be pressed. Upon doing so, the ATM clears the date; thus, enabling the customer to enter the correct date.

If the correct date has been entered and the customer wishes to proceed with adding this new expected debit, the function key indicated with reference numeral 110 may be pressed. Upon doing so, the ATM changes to a ninth state 220 illustrated in FIG. 18.

As shown in FIG. 18, when in state 220, a visual output 222 inquires whether the date and amount of the new expected debit is correct. If the answer is "No", the function key indicated with reference numeral 110 may be pressed. When this key is pressed, the ATM returns to the seventh state shown in FIG. 16. There, the customer would be able to re-enter the new expected debit amount or cancel the process as set out above. If, however, the answer is "Yes", the function key indicated with reference numeral 111 may be pressed. When this key is pressed, the ATM transmits the requested change to the host banking system or other server for storing in a data store and, thereafter, reverts back to the sixth state shown in FIG. 15.

Figure 19:
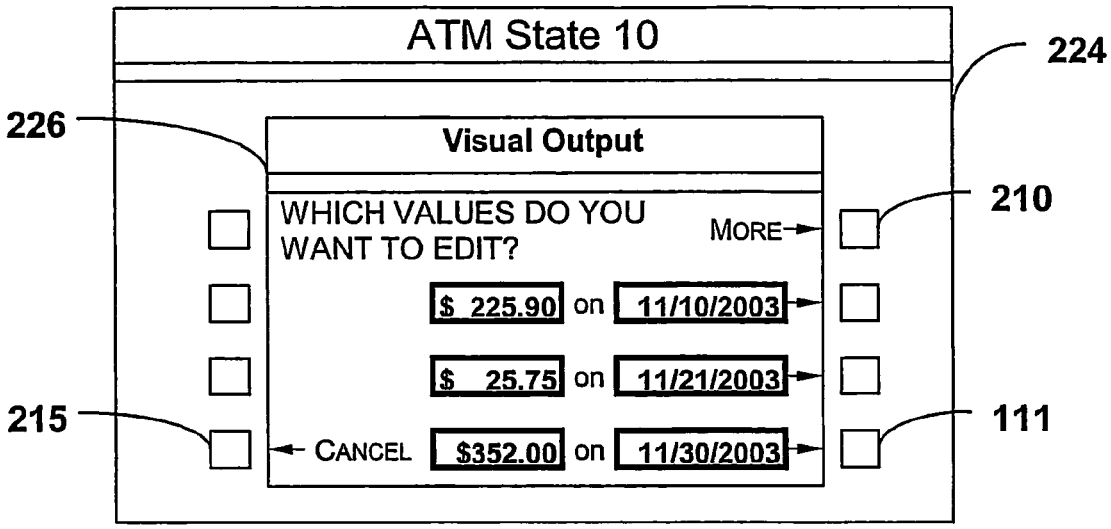

Now referring back to FIG. 15, in order to review/edit a prescribed expected debit, the function key indicated with reference numeral 110 may be pressed. When this function key is pressed, the ATM changes to a tenth state 224 illustrated in FIG. 19. As shown in FIG. 19, when in state 224, a visual output 226 inquires which prescribed expected debit does the customer wish to edit. The amounts shown are those which have been previously prescribed by the customer as set out above, including any amounts that may have been entered by the customer at an appropriately equipped ATM or though a web site provided by a customer's financial institution or other entity for example. Typically, the debits are listed in chronological order. However, in other exemplary embodiments the expected debits may be sorted by amount or description.

If there are more debits than those illustrated, the visual output 226 may include a function key 210 associated with the term "More". If the function key 210 is pressed, the ATM changes to another state (not shown) which lists the next set of expected debits. When the ATM state changes to show additional sets of expected debits, the ATM displays a function on visual output 226 which enables the customer to go back to a preceding set of debits. This function can be identified by the ATM displaying the term "Back" (not shown) for example.

If the customer no longer wishes to review/edit the listed expected debits, the function indicated with reference numeral 215 may be pressed. When this key is pressed, the ATM changes back to the sixth state shown in FIG. 15. However, if the customer does wish to edit an expected debit, the function key that corresponds with the debit which is to be edited would be pressed. For purposes of illustration, a presumption will be made that the customer wants to edit the expected debit associated with the function key indicated with reference numeral 111. Accordingly, when this key is pressed, the ATM changes to an eleventh state 228 illustrated in FIG. 20.

Figure 20:
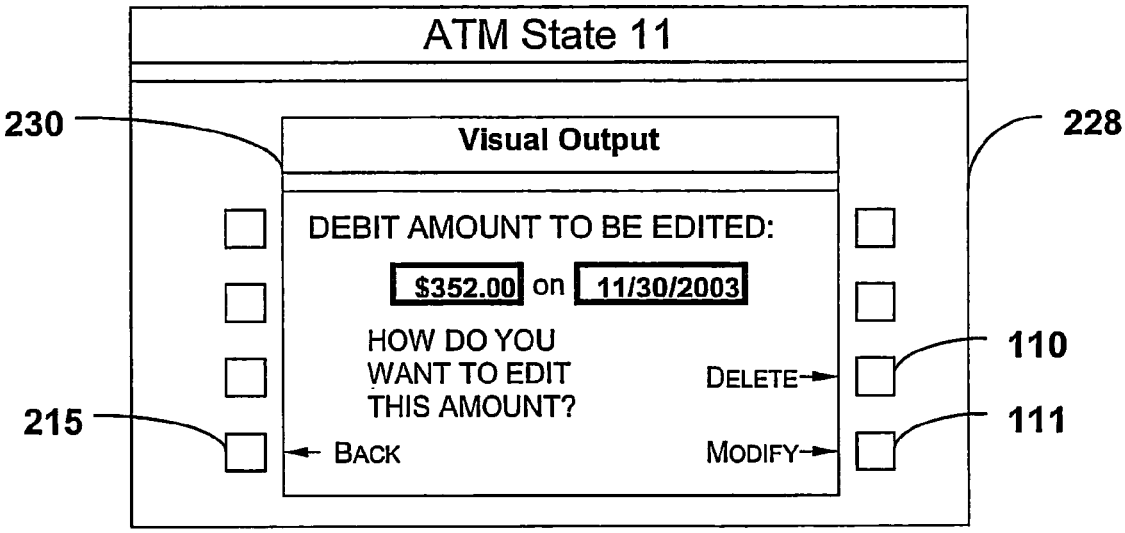

As shown in FIG. 20, when in state 228, a visual output 230 shows the date and amount of the expected debit which is to be edited. The visual output 230 may also inquire how the expected debit is to be edited. If the customer no longer wishes to edit that particular prescribed debit, the function indicated with reference numeral 215 may be pressed. When this key is pressed, the ATM reverts back to the tenth state shown in FIG. 19. However, if the customer wishes to delete the expected debit, the function indicated with reference numeral 110 may be pressed. When this key is pressed, the ATM transmits a message to the host banking system or other server to delete this value from the data store so that it will not be considered in the calculation of the account's disposable cash amount. The ATM may then return back to tenth state shown in FIG. 19.

Finally, if the customer wishes to modify the expected debit, the function indicated with reference numeral 111 in the eleventh state shown in FIG. 20 may be pressed. When this key is pressed, the ATM may change to a state which corresponds to the previously described seventh, eighth and ninth states shown in FIGS. 16-18. In the exemplary embodiment, when the ATM proceeds through the seventh, eighth and ninth states to modify expected debits, the visual outputs may include the original values for the debit amount and debit date. The customer may then clear and re-enter different amounts or dates as desired.

Referring back to FIG. 15, a customer may choose to enter one or more expected credit values by pressing the corresponding function keys indicated by the visual output 208 in the sixth state. The date or dates associated with the expected credits may be used to determine the next Credit Date. As discussed previously, The Total Forthcoming Debits are determined responsive to the Current Date and the next Credit Date. In an alternative exemplary embodiment, rather than providing functions for entering and modifying expected credits, the ATM may provide a visual output with a function selectable by the customer to enter a specific day of the month to correspond to the next Credit Date. In this described exemplary embodiment, the customer may only need to enter expected debits and a single Credit Date for use with calculating the Disposable Cash amount as discussed previously with respect to Equations 1-3.

It is to be understood that the described ATM states and visible outputs set out above are merely examples of performing transactions involving the determination of a disposable cash amount. Other transaction functions for the described ATM and alternative exemplary embodiments of the ATM may have additional and/or other types of ATM states, visible outputs, and/or audible outputs which enable a customer to view a disposable cash amount for an account and/or perform transactions using the disposable cash amount.

Another exemplary embodiment of the invention allows an ATM user to review private memos (e.g., notes or memorandums) at an ATM. The memos can be previously created by the user, such as at a location remote from the current ATM. A person can send a message to themself for later viewing of the message at an ATM. An ATM user can use any ATM in a linked network of ATMs to remotely access, display, and print previously stored memos. The wide availability of ATMs enables a person to easily retrieve their memos.

The ATM memo exemplary embodiment provides customers with a mechanism for remotely accessing any personal reminder note or information that they may not normally have access to, especially when they are away from home and on the move. It provides ATM customers with new or additional ATM functionality, e.g., the ability to display and/or print any pre-prepared personal information they wish at any ATM terminal. Thus, the exemplary embodiment effectively gives ATM users access to their data anywhere in the world. FIGS. 21-28, which are discussed in more detail herein, show examples of memo creation, storage, and retrieval.

Figures 21, 25:
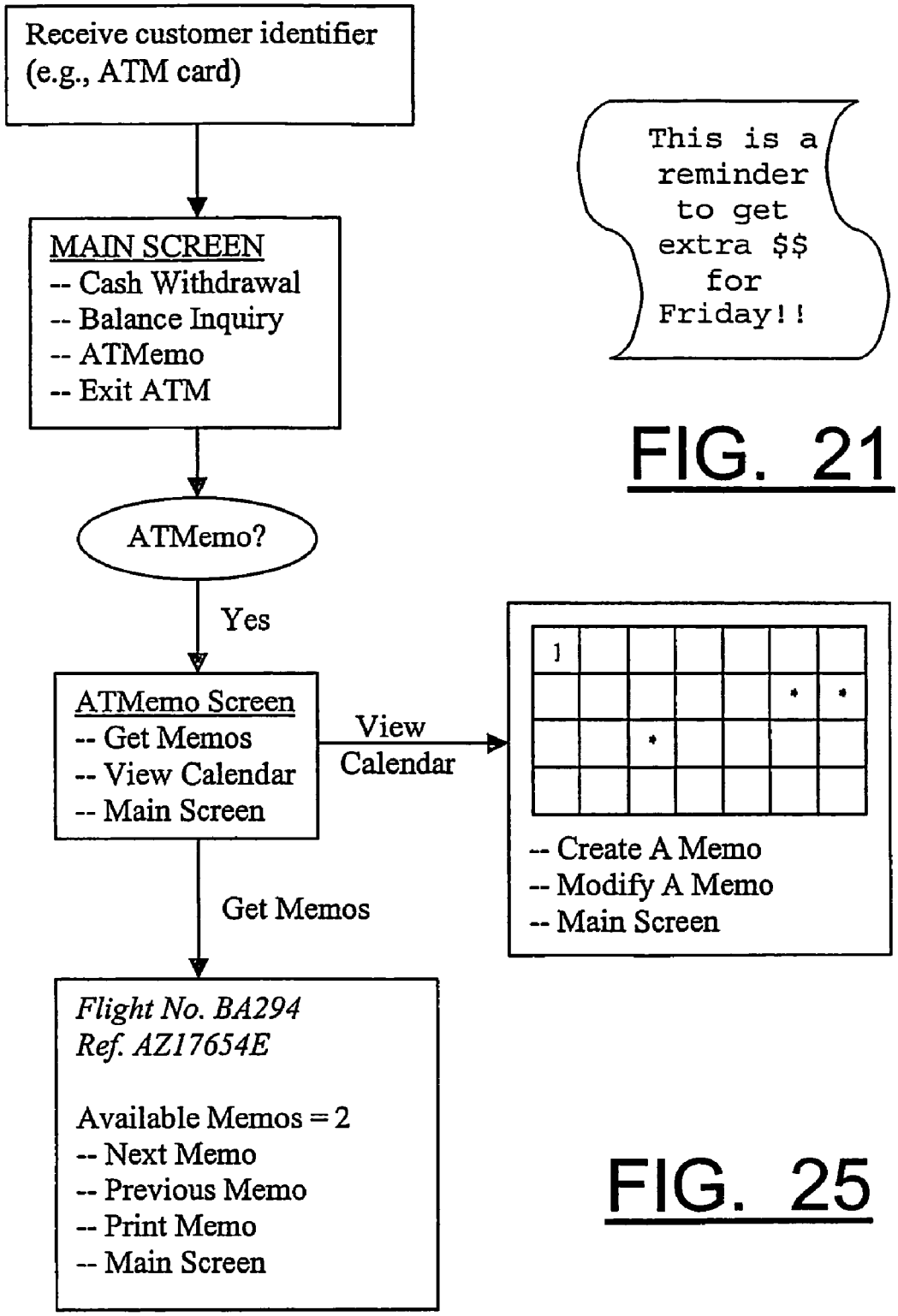
FIG. 21 shows a memo printed on a receipt.
FIG. 25 shows steps to memo display screens.

The information in a memo can include a wide range of information, including private data, reminders, numbers, etc. The memo can be stored or held in a data store or database. The memo can be stored as a record or field in the database. A memo can also be created and stored as a file. The memo can be retrieved when the memo creator uses an ATM. The exemplary embodiment allows ATM users the ability to display and print their own choice of pre-prepared private memo data at an ATM. FIG. 21 shows a memo printed on ATM receipt paper.

With the exemplary memo retrieval arrangement, a banking customer now has an alternative to keeping notes on themselves, such as in their wallet, purse, or pockets. Thus, the memo retrieval ability of the exemplary embodiment (which may be referred to as "ATMemo") provides both customers and ATM operators with an added ATM functionality and value. Additional value is provided to customers having ATMemo because they can access and/or print customized data at any supporting ATM in the world. Additional value is also provided to ATM operators offering ATMemo because it provides new and desirable functionality to their customers. An ATM operator, such as a bank, may provide the memo service free to a customer. Alternatively, a fee may be required for providing the memo service.

A memo can contain a wide assortment of information. For example, one or more memos created by an ATMemo customer may contain any combination of emergency information, anniversary dates, birthday dates, secret phone numbers or addresses, appointments (e.g., medical), travel itineraries, contact details, events, backup data or reports or presentations, shopping lists, "things to do" list, gift ideas, reminders, safe combinations, offshore bank account numbers, encrypted information, miscellaneous information. Data in a memo may also refer to another memo. The memory allocated for a single memo may have a predetermined set limit. A memo stored in a data store as a record or file can have a name or title associated therewith.

Figure 22:
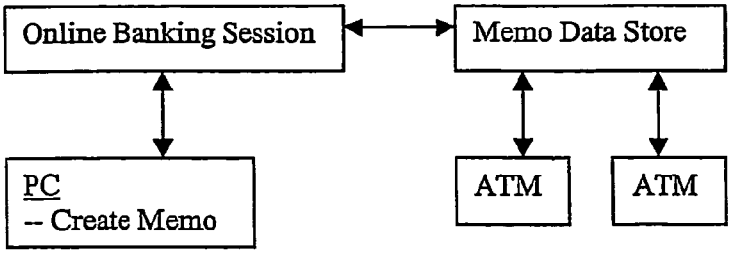
FIG. 22 shows a memo relationship among a PC, data store, and ATMs.

A memo may be produced via many different processes. An example is shown in FIG. 22. A memo is drafted using a personal computer (PC) having a web browser. The memo can be created during an electronic communication (e.g., an online banking session). The online banking software causes a created memo to be stored in a data store for memos. The data store is in operative communication with a plurality of ATMs, which enables each of the ATMs to individually access memo data from the common data store.

Figure 23:
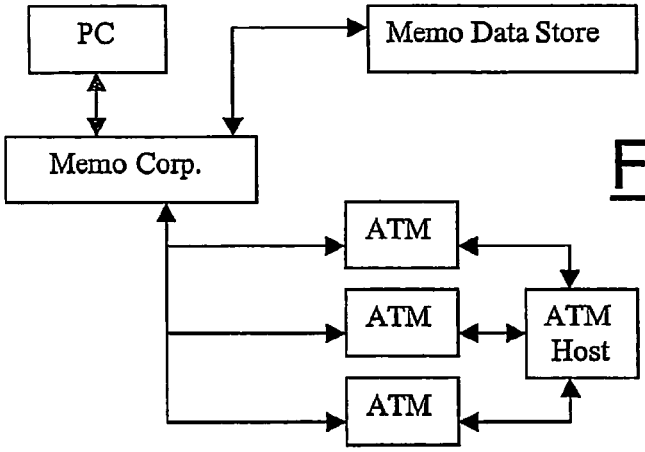
FIG. 23 shows an example of memo production.

FIG. 23 shows another example of memo production. An independent third party entity (e.g., company) is used to create, enter for storage, and retrieve memos. A customer can access the company's web site to create a memo. At the web site a customer can enter memo data into a memo insertion box. A customer saving a created memo causes the memo to be stored in the data store. The company can have one or more computers that handle the storage and retrieval of memos.

The company can have an agreement with ATM owners (e.g., banks) or an ATM network that permits the memos to be accessed via their ATMs. ATMs can be modified to include ATM software (e.g., browsers) that enables the ATM to communicate (e.g., via the Internet) with the company's server to access the memo data. The ATM software also modifies the ATM to enable an ATM user to communicate with the ATM to obtain (e.g., request, retrieve, display, print) their memos. Alternatively, an ATM may communicate with the company's server via the ATM host.

Whether a financial institution (e.g., bank) or an independent (non financial) entity oversees the storage and handling of memos, the software used in the exemplary embodiment enables a created memo to be stored in a manner that allows it to be later accessed by a customer at an ATM associated (or affiliated) with the memo's storage arrangement.

The memo creating/storing software can be on a user's personal computer, on an ATM, at a web site of the entity controlling the data store, at a web site of a bank, or any combination thereof. In some memo producing arrangements the software may require that the customer create the memo within the software, instead of independently from the software. That is, a software package (e.g., an online banking software package) may also contain memo creating software. In other memo producing arrangements a memo can be drafted as a file with a user's personal computer and then stored on the user's computer. Later the memo file can be sent to the data store for storage as a record or a file. This enables a produced memo to be sent directly from a user's personal computer to the memo data store at a convenient time.

As previously discussed (e.g., FIG. 22), a memo can be created during an online banking session, with the online banking software handling the processing of the memo into storage in a data store associated with the financial institution (e.g., bank). However, the memo creating software also allows memos to be drafted at an ATM. A memo may first be routed through a bank computer (e.g., ATM computer or ATM host computer) prior to transfer to a data store for storage therein. As discussed in more detail later, a previously stored memo can also be retrieved (from its data store) for viewing at either a personal computer or an ATM so that the memo (or record thereof) can be modified or deleted.

A previously discussed, a generated memo is stored in a data store (e.g., memory or database). The data store can hold a plurality of memos from a plurality of different customers. It should be understood that a "data store" as used herein may comprise more than one physical storage structure. In an exemplary embodiment, the data store is remotely located from the user's personal computer (where a memo may be created) and the ATMs. The data store can be maintained and controlled by a third party that is a separate entity different from the ATM operator (e.g., bank) and the customer. Alternatively, a data store may be part of an ATM network or affiliated with the ATM network. Thus, a personal memo can be created by a customer with a personal computer, sent from the personal computer to a remote data store for storage, and later accessed by the same customer from the data store through a remote ATM.

As discussed in more detail later, a memo can be stored in the data store in association or correlation with an ATM user's identification (e.g., account number or other unique identifying information) and at least one date. The date can relate to when the memo is available at an ATM, such as for scheduled display or automatic display.

Memos can be retrieved at an ATM that includes at least one computer. The ATM can also include components such as a cash dispenser, at least one display screen, and at least one printer (e.g., receipt printer and/or memo printer). The ATM can be part of an ATM network. The ATM is in operative connection with the data store, enabling the ATM to access memos stored in the data store.

The ATM can receive inputted user identification from the ATM user. The user identification (e.g., account number) may be directly accessed from a user's card, from biometric input, or from another form of identifying input. For example, a card reader may be used to read user identification data (e.g., an account number) from a user's card. Alternatively, inputted user data may first be associated with other data to determine the user's identification for retrieving memos.

An ATM uses the user's identification to request available memos from the data store which correspond to that unique user. The data store can include or be associated with another computer involved in communicating with and retrieving memos for an ATM. In a memo request operation, the ATM transmits the ATM user's identification to the data store in a request for the user's available memos. As discussed in more detail later, an ATM can be programmed differently to submit the request at different times. For example, the ATM may send the memo request immediately after recognizing the user's authority to access memos. Alternatively, a memo request may be sent after the user initiates the request via a selection to check for available memos.

In an exemplary embodiment financial transactions are carried out at the ATM via communication between the ATM and the ATM host. The communication may be proprietary, which may include secured use of the Internet. Memo retrieval is carried out at an ATM via communication between the ATM and the memo data store. The ATM communication with its host can be independent or separate from the ATM communication with the data store. That is, in an exemplary embodiment (e.g., FIG. 24) the ATM can directly request memos from the data store, without involving the ATM host. An ATM controller or computer can control and prioritize the communications. Both the ATM and the data store can be associated with one or more servers to enable transfer of data therebetween. The ATM and the data store can communicate with each other via a network such as the Internet or WWW.

As previously discussed, an ATM can ask the data store to check for available memos that correspond to the provided user identification. Based upon the received user identification, the data store (or a computer thereof) can retrieve the correlating available memos. The data store may contain a plurality of memos belonging to the same user. However, not all of that user's memos may be available for accessing. This is because the memos can be date sensitive. Thus, a memo can be accessed responsive to both the user identification and at least one date.

The memo author can select when the memo is available for display at an ATM. That is, the date of display or a display period (e.g., having more than one date) is customer-selectable. The memo software includes a memo scheduler calendar that can be displayed (at a PC or ATM) to allow a customer to easily attach or assign memos to specific calendar dates. The software enables a customer to access their electronic calendar to assign memo display periods. During display date assignment, the customer can drag and drop memos onto specific calendar dates, including a range of calendar dates. Other memo input choices to the calendar enable the customer to select a range option which lets the customer indicate the beginning display date and ending (or expiration) display date for the range. A memo expiration date can also be provided and stored in the data store. Other (important) memos can be set as continually available for display until specifically canceled (e.g., deleted from the data store) by the customer.

An example of setting a memo date will now be discussed. A memo regarding a birthday reminder may be designated for display during the two-week period prior to (and including) the actual birthday date. Thus, if the ATM customer were to access their available memos at any time within this designated two-week period, the birthday reminder message would be one of the memos retrieved from the data store for review. Every day within the two-week period the birthday memo would be available and would be automatically retrieved in response to a memo retrieval request made by that particular customer at an ATM. Again, an ATM customer has the option of deleting a displayed memo so that the memo is prevented from being displayed again (e.g., removed from the data store). For example, a customer may desire to cancel a memo after it has served its purpose and no longer needs to be seen again. A delete key can be selected by the ATM user to remove a memo. The ATM can also initiate a deletion process by asking a user if they would like to have a currently displayed memo deleted, especially a memo that is still available on future dates. The user can respond to the deletion inquiry by inputting a selection that either deletes or retains the memo.

The same customer (who had the birthday memo) may want another memo containing a shopping list to only be available for display during a shorter display period, such as only three consecutive days. The availability of a memo may also be set by the creator for only a single day (e.g., 24 hours). Other memos may have even longer or shorter assigned or predetermined periods of display. Each respective memo is available for display within its respectively set (active) display period. Thus, a memo can be stored in the data store in correlation with both an ATM user's identification and a date or dates (e.g., date range).

The memo software also includes other options for allowing a customer to determine when a memo is designated or available for display. For example, a memo can be initially assigned a single display date by the customer. For a birthday memo the display date may be the actual date of the birthday. The customer can then choose one of several predetermined (extended) display periods presented by the software. Examples of extended display periods may include one day, one week, two weeks, one month, etc. With the previous birthday memo example, the customer could have selected a predetermined (extended) display period of two weeks. The software automatically calculates the extension of available dates for the memo. These available display dates comprise all days during the two-week period prior to (and including) the actual birthday date. The birthday memo becomes eligible for display when its display date is within the range of two weeks relative to the current date. The display dates are stored in correlation with the memo.

The memo software also allows a customer to customize (select) specific starting and ending dates for a memo's extended display period. The software can automatically fill in the remaining display dates between these starting and ending display dates in determining the entire display period for the memo. It should be understood that different memos can have different available display dates or display periods, and that the memo display periods is user-selectable.

As discussed in more detail later, an ATM can access and display all stored memos that have a display date that is within their particular time period (e.g., two weeks) of (after) the current date. That is, the data store controller enables the accessing of all memos pending in the data store that have a display date within a respective predetermined time (e.g., ten days) after the current date. For example, an intelligence memo may have been placed on a memo calendar for the 8th and 9th of a particular month, and further selected to be available for retrieval within one week prior to those dates. Thus, memo software allocates the intelligence memo as available for ATM display (for that particular customer's identification) on the 1st through 9th dates of the month.

A customer also has the ability to determine variable dates when a produced memo is to be available for display in response to an ATM's request for memos assigned to that customer. Some memos may be memos that are automatically made available (or active) during the same time span or period every month. For example, a memo may be directed to a recurring monthly bill, such as a mortgage payment. These types of memos can be stored in the data store in association with the memo's monthly display date range. The calendar has a display option that lets the customer view all scheduled memos for a particular month. Other display options (e.g., one year, thirty days, one week, a day, etc.) are also obtainable. Memos can be scheduled on a memo calendar years in advance of their actual display date. In some arrangements the data store can maintain an archived (and customer-accessible) record of all previously scheduled memos.

As previously discussed, a memo's display period determines when that memo is available for display at an ATM. Upon receiving a memo check request from an ATM, the data store can determine whether the current date is a date within the stored display dates for the memos belonging to the particular identification. For example, the data store computer can find the memos assigned to the received identification, compare the display period assigned to each respective found memo to the current date, determine which of the found memos match the current date, and then send (copies of) the matching memos to the ATM. Thus, a memo is accessed responsive to both the user identification and the current date. After receiving a memo from the data store, the ATM is operative to display the memo on the ATM's display screen.

A stored memo record can be automatically purged (or overwritten) from the memo storage system upon expiration of the memo's assigned display period. Expiration of a memo designated as a recurring memo would cause the memo to remain stored as a temporarily unavailable memo until arrival of its next display period.

As previously discussed, memos can be created either via a personal computer or via an ATM. A customer also has access to their memos in the data store either via a personal computer or via an ATM. The personal computer can include conventional components, such as a display monitor and a keyboard. The ATM can include conventional ATM components such as a computer and a display. However, an ATM can further be equipped with a keyboard that is displayable on a touch screen. The ATM user can operate the keyboard by touching the display screen. When using a personal computer, communication with the data store can require user identification (e.g., account number) and/or a password.

Memo software includes computer executable instructions that enable a ATMemo customer to carry out a process to receive, view, and print their memos at an ATM. Computer readable media can comprise the software. The software can be locally installed on the ATM. Alternatively, the software can operate in a computer remotely located from the ATM yet in operative communication with the ATM.

The programming software can cause the ATM to output (e.g., display) a menu which includes a user option to receive available memos or messages. The ATM can be controlled by the computer/software to present a selectable memo access option to a customer. The menu option can be part of a displayed transaction choice screen. For example, transaction choices displayed may include cash withdrawal, balance, and memos (e.g., FIG. 25). The machine user can select the memo option to access and review their memos. The ATM includes at least one input device for receiving user input corresponding to menu selection for the memo option. For example, the ATM can receive selection input via a function key, keypad, or touch screen.

FIG. 25 shows a flow diagram for an exemplary process of retrieving user memos. The user inputs an identifier (e.g., a card, fingerprint, optical scan, etc.) at the ATM. After the user is verified as an authorized ATM user, the ATM presents a choice of available user options to carry out with the ATM. The options are shown as being in a main display screen. The software causes the ATM to include one of these options as a memos retrieval option (e.g., "ATMemo"). The software enables the user to select any of the presented options.

The ATM can receive the user's ATMemo selection. Responsive to the selection, the ATM displays a subscreen that presents options available within the ATMemo heading. These options may enable a user to get their memos, view their memo schedule calendar, or return to the main screen (FIG. 25). It should be understood that the screens shown are exemplary and that other types of options can be displayed.

Figure 28:
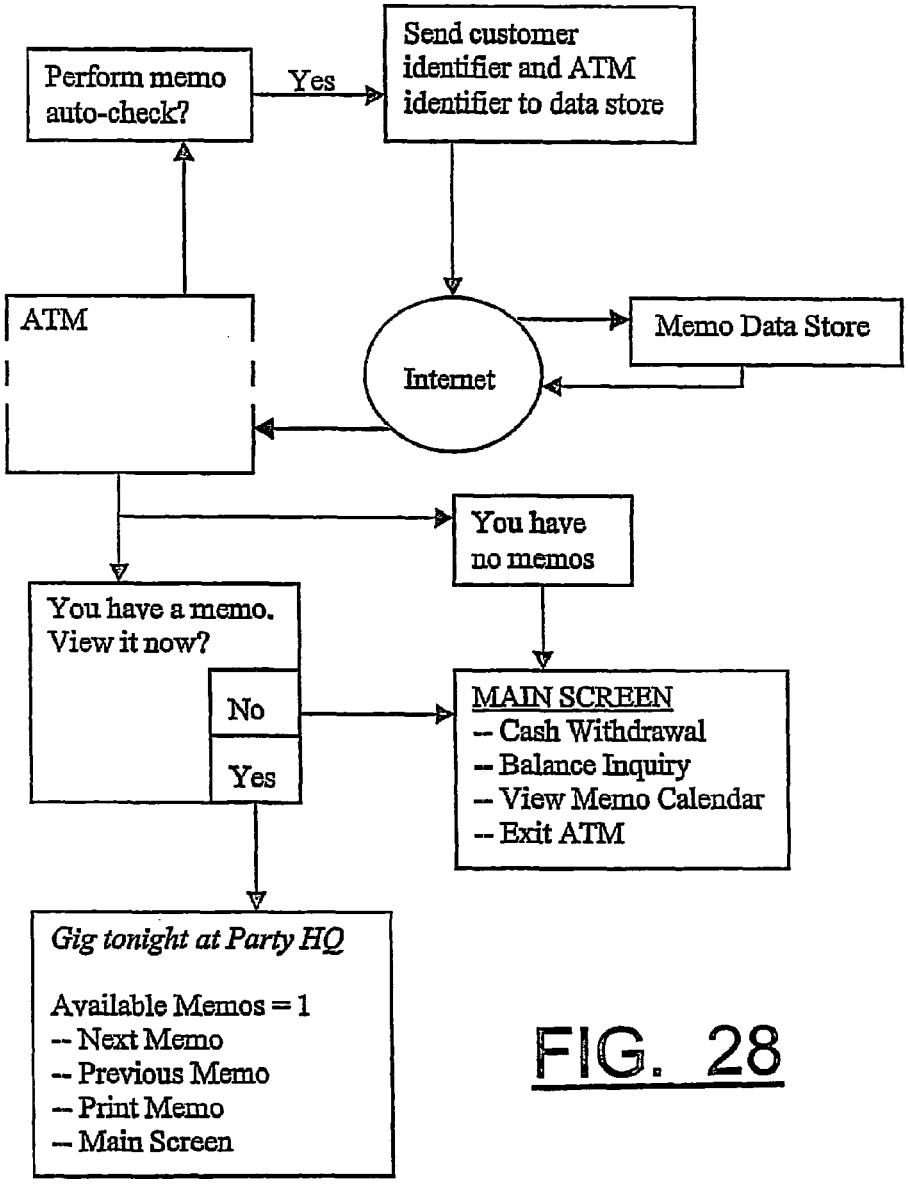
FIG. 28 shows an example of an automatic checking for a user's memos at an ATM.

Responsive to a selection to get or access the user's memos, the software causes the ATM to request from the data store the memos corresponding to that particular user. An example is shown in FIG. 28. The ATM and the data store may communicate via a network such as the Internet, where both the ATM and the data store have an Internet web address. As previously discussed, the accessing of a stored memo can be responsive to the user's inputted (memo option) selection and the user's inputted identification. Along with the request for available memos, the ATM can provide the data store with the user's identity and the ATM's identity (e.g., ATM's Internet address).

After the ATM receives the memos from the data store, the software causes the ATM to display them on an ATM display screen (e.g., flight information in FIG. 25). The memos may be displayed one at a time. Alternatively, the user may be able to scroll through retrieved memos. More than one memo may be simultaneously displayed. Furthermore, as previously discussed, a memo can be displayed in relation to one or more dates, such as in a scheduled memo in a dated calendar of memos. A displayed calendar is shown in FIG. 25. One or more memos (e.g., the pertinent, active, or available memos) may be highlighted in a displayed calendar.

The ATM also includes an option to print one or more memos. Instructions can be provided by the ATM for printing one or more memos. For example, a "print memo" option can be displayed along with a memo (FIG. 25). Again, a function key, keypad, or touch screen can be provided to enable the ATM user to select printing one or more memos. In other arrangements the user can print memos without the memos being first displayed.

A memo can be printed by a dedicated memo printer on a separate sheet of paper specifically used for memos. Alternatively, the ATM may print memos by using a common or shared printer and paper that is also used for printing other data. For example, an ATM receipt printer can be used to print memos on receipt paper (FIG. 21). The memo can be printed on (the front or back of) a transaction receipt along with transaction data. Also, a memo can be printed on receipt paper as a separate item from a printed transaction receipt. Other printing arrangements can also be used, such as printing one or more memos on mini-statement paper (with or without the mini-statement). In still further arrangements the user can download memos from the ATM to the user's portable digital recording device (e.g., MP3 player, etc.).

The ATMemo software also allows a customer at an ATM to view their personal calendar, which may be loaded onto the customer's personal PC (e.g., home computer). The personal calendar may be of the type that is modifiable by others (e.g., coworkers). The ATMemo calendar can be linked with the customer's personal calendar. This linking allows a customer at an ATM to see their schedule for the next few days so they can get cash accordingly. For example, an unexpected change (extra stops) in a traveler's work schedule or itinerary may necessitate the need for more cash. Transactions at the ATM can be performed to correspond to changes in the schedule. Portions of a personal schedule can also be printed out at an ATM.

The ATMemo software further allows a customer at an ATM to operate their home PC. Their home PC can run remote control software (such as "PC Anywhere") that enables the customer to access their home PC while located at an ATM. This allows a customer at an ATM to get information or data from their home PC, such as financial data or scheduling (e.g., personal calendar). The data reviewed from the home PC can be used to enable the customer to decide whether to perform a transaction at the ATM. For example, from the viewed data the customer can determine how much cash to request, the amount of funds to transfer to another account, how much cash to deposit, etc.

A customer at an ATM can also operate their home PC to run financial programs. For example, the customer may use their home PC to calculate minimum payments on credit card balances. This enables the customer at the ATM to know the amount of funds to leave in certain accounts in order to make the minimum payments. As a result, the customer may avoid requesting cash from affected accounts or obtain the total amount of needed cash over (from) several accounts.

Another feature of ATMemo is the ability of the customer to have ATM dispensed cash marked with removable messages. The ATM can print messages onto removable self-adhesive labels, such as post it notes. The messages can be personally drafted by the customer at the machine. For example, customer-drafted personalized messages may state "This money is for your cousin's graduation gift", "Poker money", and "These funds are to repay Bob". A customer can also select a message from a stored list of shared messages made available by ATMemo. Messages selected from the stored list may include "Happy Birthday!", "Lunch money", and "Budgeted weekly cash allowance". A message drafted by a customer can also be stored for further future use by that customer. ATMemo enables cash to be marked or labeled for allocation to different purposes.

The ATM can dispense a label directly to the customer. An ATMemo customer has the ability to request a label from the ATM with or without a corresponding cash withdrawal request from the ATM. The customer can attach a label to a single currency note or about several currency notes.

Figure 26:
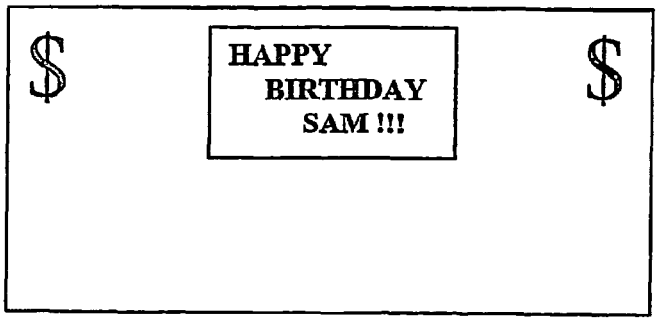
FIG. 26 shows a memo printed by an ATM onto a removable self-adhesive label.

The ATM can also place a label (having a message thereon) directly onto a single currency note, as shown in FIG. 26. An ATM dispensed currency note having thereon a removable self-adhesive label, with the label including a memo printed thereon by the ATM printer, is shown in FIG. 26. A user also has an option of selecting one of several areas on a note at which the ATM can attach the label. FIG. 26 shows the label fastened at an upper central location on the note. This location may be a default location if no other location is selected. Other selectable locations include center, upper right, lower right, upper left, and lower left locations. The locations can further be defined by being able to select whether to have an edge of the label aligned with (or on) a note edge. FIG. 26 shows the label spaced from the note's upper edge.

Figure 27:
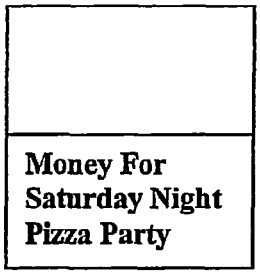
FIG. 27 shows an ATM-printed memo on a removable self-adhesive currency stack label.

The ATM can also place a label about a common edge of a plurality (stack) of notes. The label can function to hold the notes together in the stack. FIG. 27 shows a another memo printed on a larger label for a currency note stack. The label includes a center line crease to permit ease of folding over the stack. A larger portion of the label would stick to the first note and last note in the stack. In a manner previously discussed, a user can also inform the ATM as to which edge location of a stack (and the position along that edge) the ATM is to affix the label.

The ATM can attach a label to currency during the carrying out of a cash withdrawal (dispense) request. Thus, a customer not only receives their requested amount of cash from an ATM, but the cash is also labeled by the ATM for specific usage by the customer.

Upon direction from the customer, the ATM can also label different portions of a total amount of requested cash. For example, a customer may make a cash withdrawal request for $100. The customer can instruct the ATM not only to dispense the $100 but also instruct the ATM how to dispense the $100. That is, the manner or form in which the cash is to be dispensed can be dictated by the customer. From the total amount of $100 requested, the customer can cause the ATM to dispense $40 labeled "For flowers", dispense another $40 labeled "Country drive", and dispense the remaining $20 without a label. ATMemo includes software that enables an ATM customer to select cash label allocations in a cash dispensing request.

A label can remain on a note(s) during storage thereof by the customer, such as storage in a wallet or purse. Labels also function to keep different sets of allocated cash separated from each other. For example, a wallet may contain several labeled sets of note(s), with each set separated by a label. The removable note label can later be removed from the note(s) by the customer or another person. Thus, labeled notes can be returned to their original unmarked form.

In alternative embodiments, an ATM can dispense new clean (non circulated) cash when a cash request has been indicated by an ATMemo customer for use as a cash gift. Thus, the ATMemo customer can enjoy the benefit of receiving crisp new bills to give as the gift.

The memo software provides a customer many selectable options concerning when and how their memos are to be requested and displayed at an ATM. Several options have already been discussed. Further retrieval options enable the user to set up the memo retrieval process to have the ATM automatically initiate a check for their memos at ATM logon, without the ATM user having to specifically request the check.

An example of an automatic checking (or precheck) process for memos is shown in FIG. 28. After receiving the identification from an authorized user of the ATM, the ATM may first determine whether the user is a customer of ATMemo. This verification may involve the host computer. Alternatively, the ATM may just send the user's identifier data to the data store and let the data store make the determination, if necessary.

The ATM can immediately send a memo check request (along with the identification) to the database (e.g., data store). The database returns the available memos to the ATM, else the database informs the ATM that there are no memos available that correspond to the provided identification. The ATM can then inform the user whether memos are available for viewing or printing (FIG. 28). The user can then choose whether to have their available memos displayed. The ATM can also notify the user that they have no memos, and then default to the main screen. In other arrangements the ATM can automatically display the available memos without the user having to indicate that they would like to view the memos. Again, a customer has several retrieval and display settings to choose from which will dictate the actual order of process flow steps. Again, it should be understood that the display screens shown are exemplary and that other types of user options can be presented for display.

Figure 24:
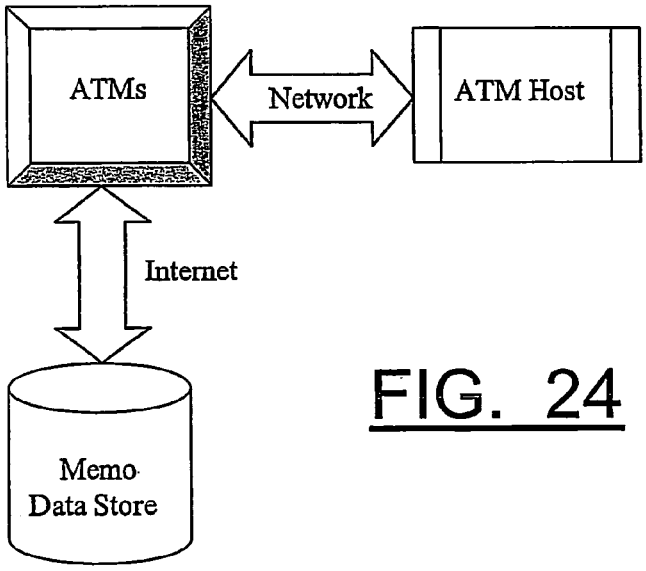
FIG. 24 shows an ATM, data store, and ATM host relationship.

The memo retrieval process can be independent of the financial transaction process, as shown in FIG. 24. The memo retrieval process can occur while the user is carrying out a financial transaction, such as requesting a cash withdrawal. Alternatively, a memo can be first accessed by the ATM and presented to a user before the user selects a financial transaction. This enables the user to review their memos before carrying out the financial transaction. The content of a memo may influence the user with regard to the type or amount of financial transaction which needs to be carried out. For example, a memo may remind the user that extra cash will be needed for an upcoming outdoor festival. Thus, the ability of a customer to first review their memos prior to performing a transaction (e.g., cash withdrawal transaction) can eliminate the need for that customer to repeat the transaction. Furthermore, in another scenario, after reviewing a memo an ATM user may conclude that no financial transaction with the ATM is even necessary. Of course, a customer can use an ATM solely for the purpose of reviewing their memos.

As previously discussed, the memo software provides a customer many selectable options concerning when and how their memos are to be created, entered for storage, and retrieved. However, the memo software also permits a customer to modify their memos. That is, all of a customer's stored memos can be retrieved (from a data store) for viewing at either a personal computer or an ATM. This enables the customer to modify or delete any of their previously created memos that are currently pending in storage.

One of the options selectable by a customer is the ability to access their electronic memo schedule calendar. With the calendar open, the customer can drag and drop memos to different dates (e.g., change a display date) or remove a memo entirely from the calendar. Memos can also be opened so that the content (e.g., data, language, text, font, graphics, images, etc.) therein can be modified or altered. The electronic calendar allows a customer to send themself a message that is retrievable at an ATM.

Other selectable options enable a customer to access memos without use of the calendar. For example, memos can be accessed or searched by date or between dates. In an exemplary embodiment a customer can also perform a word search on their memos. As a result of the search, the customer would be provided with a list of all memos containing the particular search term. There are also different search methods available to the customer. For example, a particular word may be searched for in the memo's body, title, or both. Thus, an exemplary embodiment of the memo system provides a customer with the ability to remotely access a personal note at ATMs located throughout the world.

Computer software instructions used in operating the automated banking machines and connected computers may be loaded from computer readable media or articles of various types into the respective computers. Such computer software may be included on and loaded from one or more articles such as diskettes, compact disks, CDs, DVDs, tapes, flash memory device, hard drives and/or other internal or portable storage devices placed in operative connection with the automated banking machine. Other articles which include data representative of the instructions for operating computers in the manner described herein are suitable for use in achieving operation of automated banking machines and systems in accordance with exemplary embodiments.

The exemplary embodiments of the automated banking machines and systems described herein have been described with reference to particular software components and features. Other embodiments of the invention may include other or different software components which provide similar functionality.

Thus the new automated banking machine system and method achieves one or more of the above stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function, and shall not be limited to the features and structures shown herein or mere equivalents thereof. The description of the exemplary embodiment included in the Abstract included herewith shall not be deemed to limit the invention to features described therein.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

I claim:

1. Apparatus comprising:

a data store including at least one private memo received from an individual, wherein in the data store the at least one private memo is stored associated with both individual identification data corresponding to the individual and display date data corresponding to at least one memo display date, wherein the data store is adapted to simultaneously store different private memos received from the individual which have respective different memo display dates, a cash dispensing automated teller machine (ATM) in operative connection with the data store, wherein the ATM is operative to receive on a current date, ATM user identification from an ATM user, wherein the ATM is operative to access at least one memo stored in the data store that is associated with both individual identification data that corresponds with the received ATM user identification and display date data that corresponds with the current date, wherein the ATM includes a display screen, wherein the ATM is operative to display the at least one accessed memo on the display screen, wherein the ATM includes at least one printer, wherein the ATM includes at least one removable self-adhesive label that is adhereable to a currency bill, wherein the ATM is operative to print an accessed memo on a label of the at least one removable self-adhesive label, and wherein the ATM is operative to dispense at least one currency bill having the label adhered thereto.

2. A method comprising:

(a) receiving through operation of at least one computer, at least one private memo sent by an individual via a personal device through which the private memo was created by the individual, wherein the at least one private memo includes a first memo directed to a future cash withdrawal request, wherein the first memo indicates to the individual a specific amount of money to request in the cash withdrawal request, wherein the first memo indicates to the individual a specific use for the specific amount of money, wherein the specific use includes words input to the personal device by the individual;

(b) operating the at least one computer to cause to be stored in a data store for private memos to be displayed, the at least one private memo received in step (a), wherein each respective memo is stored in the data store in correlation with both an account, and a range of display dates within which the respective memo is to be displayed, wherein each respective stored memo expires from being displayed on a first date past the respective range of display dates, wherein the data store is adapted to simultaneously store different private memos received from the individual which have respective different ranges of display dates, wherein the at least one computer is operative to determine whether the data store includes at least one expired memo, wherein the at least one computer is operative to modify the data store to cause an expired memo to be inaccessible for display;

(c) subsequent to step (b), operating the at least one computer to receive on a current date, machine user identification from at least one machine controlling computer associated with an automated banking machine that is remotely located from the data store and that includes both a cash dispenser and at least one display;

(d) operating the at least on computer to determine that the machine user identification received in step (c) corresponds to the account;

(e) responsive at least in part to step (d), operating the at least one computer to access at least one memo stored in step (b) that is correlated in the data store with both the account, and a range of display dates having a display date that includes the current date, wherein the first memo is accessed;

(f) operating the at least one computer to send to the at least one machine controlling computer, at least one message including the at least one memo accessed in step (e), wherein the at least one message is operative to cause the at least one machine controlling computer to operate the machine to display the first memo, causing both the specific amount of money to be indicated to the individual by using at least one numerical character, and the specific use words to be indicated to the individual by using letter characters, wherein the at least one computer is operative subsequent to display of the first memo, to modify the data store to cause the first memo to be inaccessible for further display responsive at least in part to at least one machine user input to the machine.

3. The method according to claim 2 wherein the automated banking machine includes at least one display screen, wherein step (f) includes operating a display screen of the machine to display the first memo.

4. The method according to claim 3 wherein step (f) includes displaying the first memo as a scheduled memo in a dated calendar displayed on the display screen.

5. The method according to claim 2 and further comprising (g) prior to step (e), operating the at least one computer to compare the range of display dates to the current date.

6. The method according to claim 1 wherein in step (a) the personal device comprises a personal computer.

7. The method according to claim 1 wherein prior to step (a), further comprising (g) producing the at least one private memo with the personal device, and (h) sending the at least one private memo produced in step (g) from the personal device to the at least one computer.

8. The method according to claim 1 wherein the machine user identification corresponds to a user of the machine, wherein prior to step (e), further comprising (g) presenting a selectable user option at the machine, wherein the user option enables the machine user to access at least one stored memo;

(h) receiving machine user input at the machine corresponding to selection of the user option, wherein step (e) includes accessing at least one memo stored in step (b) responsive at least in part to the machine user identification and the machine user input.

9. The method according to claim 1 and further comprising (g) determining through operation of the at least one computer, whether the data store includes at least one expired memo which expired from being displayed; and (h) if step (g) results in a positive determination, then modifying through operation of the at least one computer, the data store to cause the at least one expired memo to be inaccessible for display.

10. The method according to claim 9 wherein step (h) includes causing the at least one expired memo to be inaccessible responsive at least in part to operation of the machine.

11. The method according to claim 1 and further comprising (g) subsequent to step (f), operating the at least one machine controlling computer to cause the machine to receive from the individual, a cash withdrawal request corresponding to the specific amount of money that was indicated to the individual by displaying the first memo in step (f).

12. The method according to claim 11 and further comprising (h) operating the at least one machine controlling computer to cause the machine to operate the cash dispenser to dispense never-circulated clean cash responsive at least in part to the cash withdrawal request received in step (g).

13. The method according to claim 12 wherein in step (f) the specific use words comprise a reminder concerning a cash gift.

14. The method according to claim 1 and further comprising (g) operating the at least one machine controlling computer based on the specific amount of money, to cause the machine to display to the individual, an inquiry as to whether the individual wants to make a cash withdrawal that includes the specific amount of money.

15. The method according to claim 1 and further comprising (g) operating the at least one machine controlling computer responsive at least in part to receiving the at least one message, to cause the ATM to automatically dispense cash corresponding to the specific amount of money.

16. The method according to claim 1 and further comprising (g) operating the at least one machine controlling computer to cause the machine to operate the cash dispenser to dispense never-circulated clean cash associated with the specific amount of money.

17. The method according to claim 16 wherein in step (f) the specific use words comprise a reminder concerning a cash gift of clean cash.

18. Apparatus comprising:

at least one data store for storing private memos to be displayed, wherein the at least one data store is adapted to simultaneously store different private memos received which have respective different ranges of display dates, at least one computer, wherein the at least one computer is operative to receive at least one private memo sent by an individual via a personal device through which the private memo was created by the individual, wherein the at least one private memo includes a first memo directed to a future cash withdrawal request, wherein the first memo indicates to the individual an amount of money to request in the cash withdrawal request, wherein the first memo indicates to the individual a specific use for the specific amount of money, wherein the specific use includes words input to the personal device by the individual, wherein the at least one computer is operative to cause the at least one private memo received to be stored in the at least one data store, wherein the at least one computer is operative to cause each respective memo to be stored in the at least one data store in correlation with both an account and a range of display dates within which the respective memo is to be displayed, wherein the range of display dates correlated with the first memo comprises a first memo range of display dates, wherein each respective stored memo expires from being displayed on a first date past the respective range of display dates, wherein the at least one computer is operative to determine whether the data store includes at least one expired memo, wherein the at least one computer is operative to modify the data store to cause an expired memo to be inaccessible for display, wherein the at least one computer is operative to receive on a current date, machine user identification from at least one machine controlling computer associated with an automated banking machine that is remotely located from the data store and that includes both a cash dispenser and at least one display, wherein the at least one computer is operative to determine whether machine user identification received corresponds to the account, wherein responsive at least in part to both the machine user identification corresponding to the account, and the current date being in the first memo range of display dates, the at least one computer is caused to operate to access the first memo from the at least one data store, wherein the at least one computer is operative to send to the at least one machine controlling computer, at least one message including the first memo accessed, wherein the at least one message is operative to cause the at least one machine controlling computer to operate the machine to display the first memo, causing both the specific amount of money to be indicated to the individual by using at least one numerical character, and the specific use words to be indicated to the individual by using letter characters wherein the at least one computer is operative subsequent to display of the first memo, to modify the data store to cause the first memo to be inaccessible for further display responsive at least in part to at least one machine user input to the machine.

19. The apparatus according to claim 18 wherein the at least one machine controlling computer is operative to present a selectable user option to the machine user, wherein the user option enables the machine user to view at the machine at least one private memo stored in the data store, wherein the at least one machine controlling computer is operative to receive machine user input corresponding to selection of the user option, wherein the at least one computer operates to access the at least one private memo stored in the data store responsive at least in part to the at least one machine controlling computer receiving the user input.

20. The apparatus according to claim 18 and further comprising the first memo.

* * * * *